US008186612B2

(12) United States Patent
Gelli et al.

(10) Patent No.: US 8,186,612 B2
(45) Date of Patent: May 29, 2012

(54) METHOD AND DEVICE FOR GLUING THE FREE EDGE OF A LOG OF WEB MATERIAL IN A REWINDING MACHINE

(75) Inventors: Mauro Gelli, Lucca (IT); Romano Maddaleni, Pisa (IT); Graziano Mazzaccherini, Lucca (IT)

(73) Assignee: Fabio Perini, S.p.A., Lucca (IT)

( * ) Notice: Subject to any disclaimer, the term of this patent is extended or adjusted under 35 U.S.C. 154(b) by 333 days.

(21) Appl. No.: 12/311,967

(22) PCT Filed: Oct. 25, 2007

(86) PCT No.: PCT/IT2007/000745

§ 371 (c)(1),
(2), (4) Date: Apr. 21, 2009

(87) PCT Pub. No.: WO2008/050370

PCT Pub. Date: May 2, 2008

(65) Prior Publication Data

US 2010/0025515 A1 Feb. 4, 2010

(30) Foreign Application Priority Data

Oct. 27, 2006 (IT) ..... FI2006A0262

(51) Int. Cl.
*B65H 19/28* (2006.01)

(52) U.S. Cl. ..... 242/532; 242/532.3; 242/542.1

(58) Field of Classification Search ..... 242/532, 242/532.3, 542.1

See application file for complete search history.

(56) References Cited

U.S. PATENT DOCUMENTS

| | | | | |
|---|---|---|---|---|
| 3,369,766 | A | 2/1968 | Herman | |
| 4,487,377 | A | 12/1984 | Perini | |
| 6,494,398 | B1 * | 12/2002 | De Matteis et al. | 242/521 |
| 7,546,970 | B2 * | 6/2009 | McNeil et al. | 242/533.4 |
| 2008/0236773 | A1 * | 10/2008 | Gelli et al. | 162/123 |

FOREIGN PATENT DOCUMENTS

| | | | |
|---|---|---|---|
| GB | 1167767 | | 10/1969 |
| WO | WO 01/64563 | A2 | 9/2001 |
| WO | WO 01/64563 | A3 | 9/2001 |
| WO | WO 2004/005173 | A1 | 1/2004 |
| WO | WO 2004/046006 | A2 | 6/2004 |

* cited by examiner

*Primary Examiner* — Sang Kim
(74) *Attorney, Agent, or Firm* — Breiner & Breiner, L.L.C.

(57) ABSTRACT

A rewinding machine for producing logs of web material is described which includes a winding unit; a feed path of the web material towards the winding unit; a severing device to sever the web material upon completion of winding each log; and a glue dispenser to apply a glue to the web material. The machine also includes a diverter member disposed and controlled to temporarily divert the web material towards the glue dispenser.

11 Claims, 21 Drawing Sheets

N
13
$f_N$
1
31
37
39
27B
$f_{33}$
E
25A
23
$f_{23}$
C
33
35
D
25
25A
21
27A
3
5
9
11
B
A
L
17
5A
7

N
13
1
31
f37
fN
27B
39
37
25
25A
23
33
E
f23
f33
C
35
D
25A
21
27A
3
5
9
11
B
A
L
5A
17
7

N
13
1
$f_N$
31
39
37
E
27B
25A
23
$f_{23}$
C
$f_{33}$
33
33A
35
D
25
25A
21
27A
N
CL
5
3
9
11
B
A
L
17
5A
7

N
13
$f_N$
1
37
39
31
E
27B
25A
23
33
C
$f_{23}$
35
33A
D
25
25A
21
27A
N
5
3
9
11
B
5A
A
17
L
LT
CL
Lc
7

N
fN
13
91
89
93
21
23
25A
25
25A
A
61
53
f53
XX
5
101
91
9
11
A
L
17
5A
67
A
63A
63B
69
71
f65
73
C2
7
G
75
75A

N
Fw
13
91
89
93
21
23
25
25A
25A
53
5
101
XX
17
5A
9
11
A
L
7
63B
67
75A
75
G
A
63A
65
71
A
61
73
C2

N
FW
13
113
117
111
5
131
53
21
23
25A
25
9
11
A
L
17
5A
7
75A
63B
67
75
G
63A
65
71
61
73
C2

N
FN
13
111
113
117
21
23
25
25A
25A
9
11
A
L
53
Lc
5A
XX
131
LT
A
75A
75
G
7
61
A
63B
71
63A
65
73
C2

METHOD AND DEVICE FOR GLUING THE FREE EDGE OF A LOG OF WEB MATERIAL IN A REWINDING MACHINE

TECHNICAL FIELD

The present invention relates to a method for producing logs of web material. In a particular embodiment, the invention relates to a method and to a machine for producing logs of web material with a glued edge.

STATE OF THE ART

In the field of converting of tissue paper and of other materials in web form it is often necessary to wind a web material from a parent reel or from another source of material into logs of suitable dimensions.

In particular, in the field of production of rolls of toilet paper, paper towels for domestic and industrial use and other similar products, tissue paper is produced by continuous machines with a dry or wet system and wound in large parent reels. These are subsequently unwound feeding the web material to a rewinding machine which, from a single reel or from several plies fed from several reels unwound in parallel, produces a plurality of logs with a diameter equal to the diameter of the finished product to be placed on the market and the axial length of which is a multiple of the axial length of the rolls for consumption. These logs are subsequently cut transverse to the axis thereof into small individual rolls, which in turn are sent to packaging machines.

One of the needs that occurs in this production cycle is to secure the final edge or free tail edge of the material wound on each log. If this edge were not secured by gluing, in the steps subsequent to rewinding there would be the risk of the outermost turns of the log becoming unwound, with consequent risks of malfunction of the line or even causing its shutdown.

According to conventional technology, to glue the free edge of logs delivered from rewinding machines, gluing machines or tail sealers are provided downstream of these machines. The presence of these gluing machines implies an increase in the dimensions of the line and an increase in its cost, also in view of the fact that in certain cases a single rewinding machine must be combined with a double gluing machine, due to the different production speeds of these two machines. It may also be necessary to provide an intermediate storage area between the rewinding machine and the gluing machine, which in turn increases the cost and dimensions of the line.

Therefore, rewinding machines have recently been developed in which glue is applied directly in the area of the web material that will form the free edge of each log.

U.S. Pat. No. 4,487,377 describes a rewinding machine in which logs of web material are formed around tubular winding cores. In an embodiment, a glue is applied to the winding core on which a log is to be wound. At the start of the winding cycle of a new log, the core is fed towards the winding cradle in which winding of the previous log is being completed and part of the glue applied to the core is transferred by contact to the final edge of the previous log.

WO-A-2004/005173 describes a rewinding machine in which nozzles spray glue onto an area of the web material that will form the final edge of the log formed by the rewinding machine. In a different embodiment, glue is applied to a winding core and is transferred therefrom to the final edge of the web material.

WO-A-01/64563 describes a rewinding machine in which glue applicator nozzles spray a glue onto the portion of the web material that will form the final edge of the log.

WO-A-2004/046006 describes rewinding machines in which a rotating or oscillating mechanical member applies glue to the final edge of the web material. In a possible embodiment the glue applicator device is integral with the feeder of the winding cores and in a different embodiment the glue applicator device is integral with the severing device of the web material. In a further embodiment glue is applied to the tubular winding core and transferred therefrom to the final edge of the log.

In many known embodiments, glue is picked up from a reservoir or from another container by means of a moving mechanical member which, rotating or oscillating, during the "changeover" step transfers an adequate quantity of glue to the web material forming the final edge of the individual log. Changeover step is intended as the step of the winding cycle during which winding of a log is completed, the web material is severed and winding of the subsequent log commences.

These machines and these methods, which allow glue to be applied to the final edge of each log directly in the rewinding step, have eliminated the need for gluing machines downstream of the rewinding machine. Nonetheless, these solutions have some limits prevalently related to the reduced speed at which these machines are able to operate due to the risk of sprays of glue forming if the mechanical glue distribution members are operated at excessive speeds. The use of gluing nozzles also has some drawbacks, in particular related to the poor precision with which glue is applied.

Moreover, the need to operate the glue dispenser intermittently causes further constructional and control difficulties. A further difficulty lies in the fact that the log on which the final edge has been wound is not subjected to high pressure to stabilize gluing of the final edge, and consequently in order to obtain adequate bonding, capable of withstanding the subsequent handling operations of the log without accidental unwinding of the final edge, greater quantities of glue would be necessary or useful with respect to the quantities that current machines are able to dispense.

The aforesaid problems are encountered both in machines for winding web material around winding cores and in machines for winding logs without central winding cores. Moreover, problems related to gluing the free edge occur regardless of the type of winding system utilized and some of the aforesaid problems can occur both in peripheral or surface rewinding machines, in which logs are formed in a volume defined by moving or rotating members (such as rollers or belts) that transmit rotational movement to the log being formed, as well as in central winding machines, where the log is made to rotate by an axial spindle.

When the log is formed around a winding core, it is also necessary to make the initial free edge of the log adhere to the core. In some cases this operation takes place by applying a glue. As a rule, this is applied to the core, but it could also be applied to the web material. In this case at least some of the aforesaid problems can occur. For example, in currently known systems to apply glue to secure the initial free edge to the winding core, if they are designed to apply glue to the web material rather than to the core, the precision can be low and problems of soiling the machine can occur, especially at high speeds.

OBJECTS AND SUMMARY OF THE INVENTION

According to a first aspect, an object of the invention is to provide a method for more efficient gluing of the final free end of logs directly in the rewinding machine.

A further object of the present invention is to provide a rewinding machine with more efficient means for applying glue to the initial and/or final edge of logs formed by this machine.

According to an advantageous embodiment, in order to entirely or partly solve the aforesaid problems, a method for producing logs of web material is provided, comprising the steps of:

feeding a web material along a feed path towards a winding area;

winding a specific quantity of web material in a log;

upon completion of winding a log, severing the web material, forming a final free edge and an initial free edge to start winding a subsequent log.

Advantageously, according to the invention the feed path of the web material is temporarily diverted towards a glue dispensing member so as to apply a glue to the web material by drawing the web material towards a glue dispensing member. In an advantageous embodiment, the glue dispenser does not require to be controlled with an intermittent movement but can, for example, be designed in the form of a roller, which is maintained in constant rotation.

Moreover, by adopting particular constructive measures, it is possible to apply a much greater quantity of glue to the web material with respect to the quantity that can be applied using conventional systems, as the glue dispenser can, for example, be provided with an engraved roller that rotates at a different speed with respect to the feed speed of the web material and preferably with a lower peripheral speed with respect to the feed speed of the web material. By diverting the web material towards the glue dispensing roller rotating at a peripheral speed lower than the speed of the web material, and which has adequate surface engraving, even very large quantities of glue can be applied to guarantee, in the subsequent free-edge closing step, adequate securing of the final free edge of the web material to the log even without high bonding pressures. By forming, e.g., a surface film or layer of glue on the roller, the web material does not come into contact with the roller, which can rotate at a speed which is even substantially lower than the feed speed of the web material, facilitating construction of the machine and reducing dynamic problems, including those linked to the risk of centrifugation of the glue, even at high feed speeds of the web material, which in modern machines exceeds 1000 m/min.

According to a possible embodiment glue is applied to a portion of the web material before it is severed adjacent to the line along which severing of this web material will take place.

Severing can take place in any one of the known manners, for example by control and timely variation of the rotation speed of the winding rollers; using a cutting system, using jets of air or suction systems, with pinching members that locally decelerate or accelerate the web material, with pneumatic or mechanical blades, or in any other suitable manner, as the methods with which the web material is severed are not important for the purposes of the present invention.

According to an advantageous embodiment, the diverter member can have a speed substantially equal to the feed speed of the web material along the feed path, to reduce as much as possible any disturbance in the feed of the web material by the diverter member.

The diverter member could also theoretically be a suction system arranged on the same side of the feed path as the glue dispenser. However, according to an advantageous embodiment of the method according to the invention, the glue dispensing member is arranged on a first side of the feed path, and the diverter member is arranged on a second side of the feed path, opposite the glue dispensing member.

Further advantageous features and embodiments of the method according to the invention are set forth hereunder with reference to some non-limiting embodiments of the invention and are further set forth in the appended claims.

The method of the present invention is advantageously applied above all to apply glue to, or in proximity of, the final edge of the log, but it would also be possible to use the same criterion to apply glue to the portion of the web material in proximity of or coinciding with the initial free edge, to cause adhesion thereof to the new winding core. Moreover, the concept underlying the present invention could also be utilized to apply glue both to the initial edge and to the final edge of the web material so as to close the final edge of the log and secure the initial edge to the winding core of the subsequent log.

According to a different aspect, the invention relates to a rewinding machine for producing logs of web material comprising: a winding unit; a feed path of the web material towards the winding unit; a diverter member; a device to sever the web material upon completion of winding each log; a glue dispenser to apply a glue to the web material. According to an advantageous embodiment, the diverter member is arranged and controlled to temporarily divert the web material towards the glue dispenser.

In a possible embodiment, the glue dispenser comprises a rotating roller arranged along the feed path of the web material and on one side thereof. The roller can have a substantially cylindrical surface, for example engraved according to inclined helical lines which intersect to define truncated-pyramid shaped protuberances. With this structure, similar to that of an embossing roller, a surface engraving pattern is formed on which a large quantity of glue can be collected to form a surface film. The web material, diverted towards the winding roller, can "float" on this film without coming into mechanical contact with the actual roller. As indicated above, this advantageously allows the glue dispenser to rotate at a peripheral speed different than the feed speed of the web material, typically at a lower speed than the latter.

The diverter member can be arranged upstream of the winding unit. This unit can comprise one or more winding rollers, for example three winding rollers defining a winding cradle inside which at least a part of the winding cycle of the log takes place. The diverter member can be positioned, with respect to the direction of feed of the web material, upstream of the first winding roller. The glue dispenser will advantageously be arranged in front of the winding member, on the opposite side of the feed path of the web material.

According to a different embodiment, the diverter member is associated with one of the rollers around which the web material is fed, preferably around a winding roller. Advantageously, the diverter member can be arranged to perform a trajectory that extends at least partly around said roller to be inserted between the web material and the roller. The glue dispenser will be positioned on the opposite side of the feed path of the web material, level with the roller around which this material is fed. The drive or guide roller of the web material can be one of the winding rollers of a peripheral or surface winding system.

Further advantageous features and embodiments of the rewinding machine according to the invention are set forth hereunder with reference to some non-limiting embodiments of the invention and in the appended claims.

BRIEF DESCRIPTION OF THE DRAWINGS

The invention will be better understood following the description and accompanying drawing, which shows non-limiting practical embodiments of the invention. More specifically, in the drawing.

DETAILED DESCRIPTION OF EXAMPLES OF EMBODIMENT OF THE INVENTION

Figure 1:
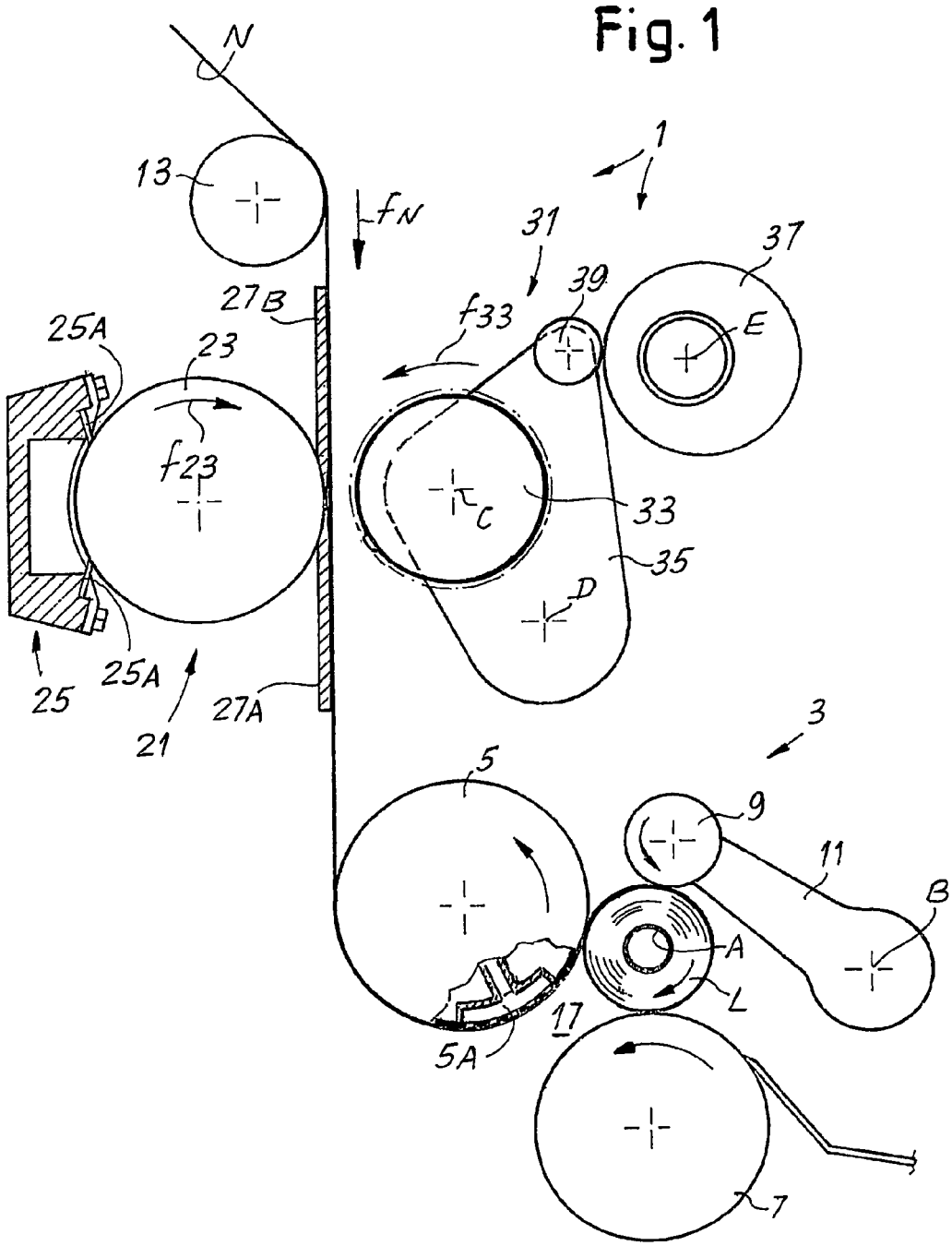
FIGS. 1, 2, 3 and 4 show a first embodiment of the invention in different operating steps.

FIGS. 1, 1A, 2, 2A, 3 and 4 show a first embodiment of a rewinding machine according to the invention and of the relative operating method. With reference to these figures, reference number 1 generally indicates a rewinding machine comprising a winding unit 3 for forming logs L of a web material N. In an advantageous embodiment the logs L are formed around winding cores A, cylindrical in shape and preferably tubular, although it would also be possible to apply the invention to rewinding machines that form logs without a winding core, or in which the winding core is only present during forming of the log and is then removed to be recycled. Moreover, the shape of the winding core can differ from cylindrical.

In an advantageous embodiment the winding unit 3 comprises a first winding roller 5, a second winding roller 7 and a third winding roller, or moving winding roller 9, supported by arms 11 oscillating about an axis B, substantially parallel to the axes of the rollers 5, 7, and 9. The winding cradle or unit 5, 7, 9 is known per se and typical of surface or peripheral winding machines. Operation thereof will not be described in greater detail below as it is already known to those skilled in the art.

According to an advantageous embodiment, the web material N moves along a feed path which extends around a guide roller 13 to the upper winding roller 5, and then around this roller towards the winding cradle formed by the rollers 5, 7, and 9, passing through a nip 17 defined between the winding rollers 5 and 7, and through which the winding core A is also fed.

In an advantageous embodiment, a glue dispenser, indicated as a whole with 21, is arranged on a first side of the feed path of the web material, between the guide roller 13 and the winding roller 5. In a possible embodiment, the glue dispenser 21 comprises a glue dispensing roller 23 cooperating with a glue feeder 25 of a type known per se and provided with doctor blades 25A to distribute glue on the cylindrical surface of the dispenser roller 23. This roller rotates according to the arrow f23 with a peripheral speed preferably lower, for example, around one tenth, with respect to the feed speed of the web material N in the direction of feed indicated with fN along the feed path. The surface structure of the glue dispenser roller 23 will be described below with reference to FIGS. 9 and 10.

According to an advantageous embodiment, a protective wall is positioned on the same side of the feed path of the web material N as the glue dispenser 21, formed of two portions 27A, 27B reciprocally movable to define a continuous protection separating the glue dispensing roller 23 from the web material N and which, by moving apart, define an opening elongated in the direction of the axis of rotation of the glue dispensing roller 23 to allow glue to be applied to the web material N in the manner described below.

According to an advantageous embodiment, a diverter member, indicated as a whole with 31, is arranged on the opposite side of the feed path of the web material N with respect to the side on which the glue dispenser 21 is located.

According to a possible embodiment, the diverter member 31 comprises a diverter roller 33 rotating about an axis C supported by oscillating arms 35 pivoting about an axis of oscillation D substantially parallel to the axis C. Oscillation of the arms 35 is controlled by an eccentric or by a cam 37 rotating about an axis E approximately parallel to the axis D. The number 39 indicates a small roller forming the feeler cooperating with the eccentric or cam 37. Thrust members, for example elastic, maintain the feeler 39 in contact with the profile of the cam or eccentric 37. Preferably, two eccentrics 37 are provided on the two side panels of the machine which can extend transversely even for several meters and in this case a feeler 39, supported idle by a respective oscillating arm 35, cooperates with each eccentric 37. At the end the two oscillating arms 35 support the diverter roller 33. Systems with several oscillating arms 35 in parallel depending on the transverse dimensions of the machine can also be provided.

Figure 1A:
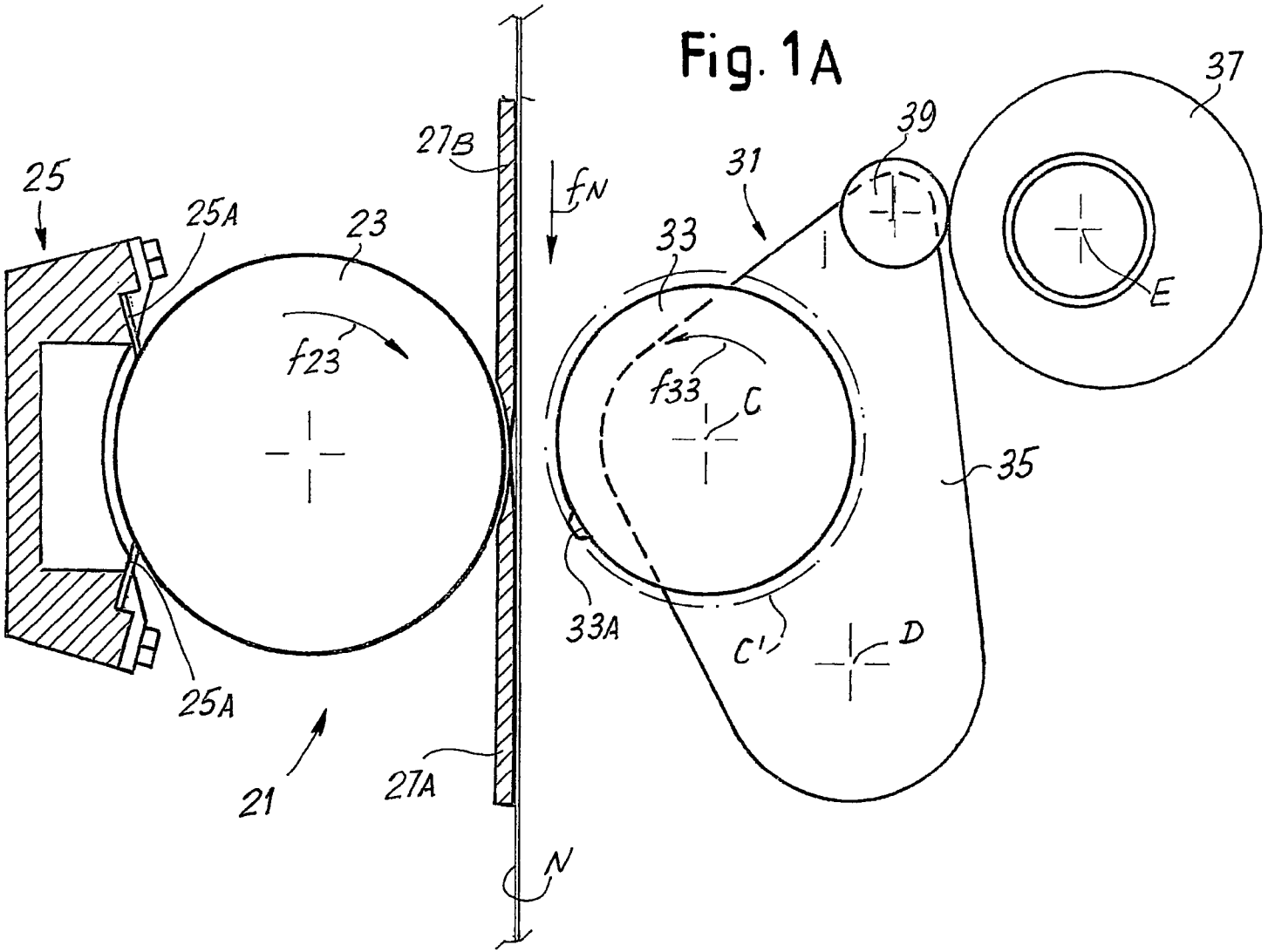
FIGS. 1A and 2A show enlargements of a detail in FIGS. 1 and 2 respectively.

As can be seen in greater detail in the enlargement in FIG. 1A, according to an advantageous embodiment, a radial projection 33A which can, for example, be constituted by an elastic rib, by a pad or the like, is arranged on the cylindrical surface of the diverter roller 33. The radial projection 33A can be constituted by a single body, extending along the axial extension of the diverter roller 33, or can be formed of a plurality of projecting elements suitably aligned with one another in a direction substantially parallel to the direction of the axis C. The continuous projecting element or projecting elements could also be aligned according to a helical line. In this case the axis C of the roller 33 can, for example, also be arranged inclined with respect to the axis of rotation of the glue dispensing roller 23. In this manner gradual contact can be obtained between the elements forming the radial projection 33A and the glue dispensing roller 23 opposite and facing the diverter roller 33. The radial projection 33A can have a reduced circumferential extension, as shown in the figure, or also a greater extension.

In FIGS. 1 and 1A is shown how the diverter roller 33 is maintained at a certain distance from the path of the web material N so that the roller 33 and the radial projection 33A do not interfere with the web material N freely advancing along the feed path thereof. In this step the walls 27A, 27B of the protection 27 are advantageously positioned contiguous to one another, to form a substantially continuous wall separating the path of the web material N from the glue dispenser 23. This protection can advantageously be provided on the one hand to avoid accidental contact between the web material N and the glue dispensing roller 23 and on the other to prevent paper dust or other debris from entering the glue dispensing roller 23 and also to protect the web material N from accidental sprays of glue, although these can advantageously be avoided by adopting sufficiently low rotation speeds of the roller 23.

The diverter roller 33 can be maintained in constant rotation, at a constant or variable speed, or can be made to rotate only during the exchange steps, during which glue must be applied.

Figure 2:
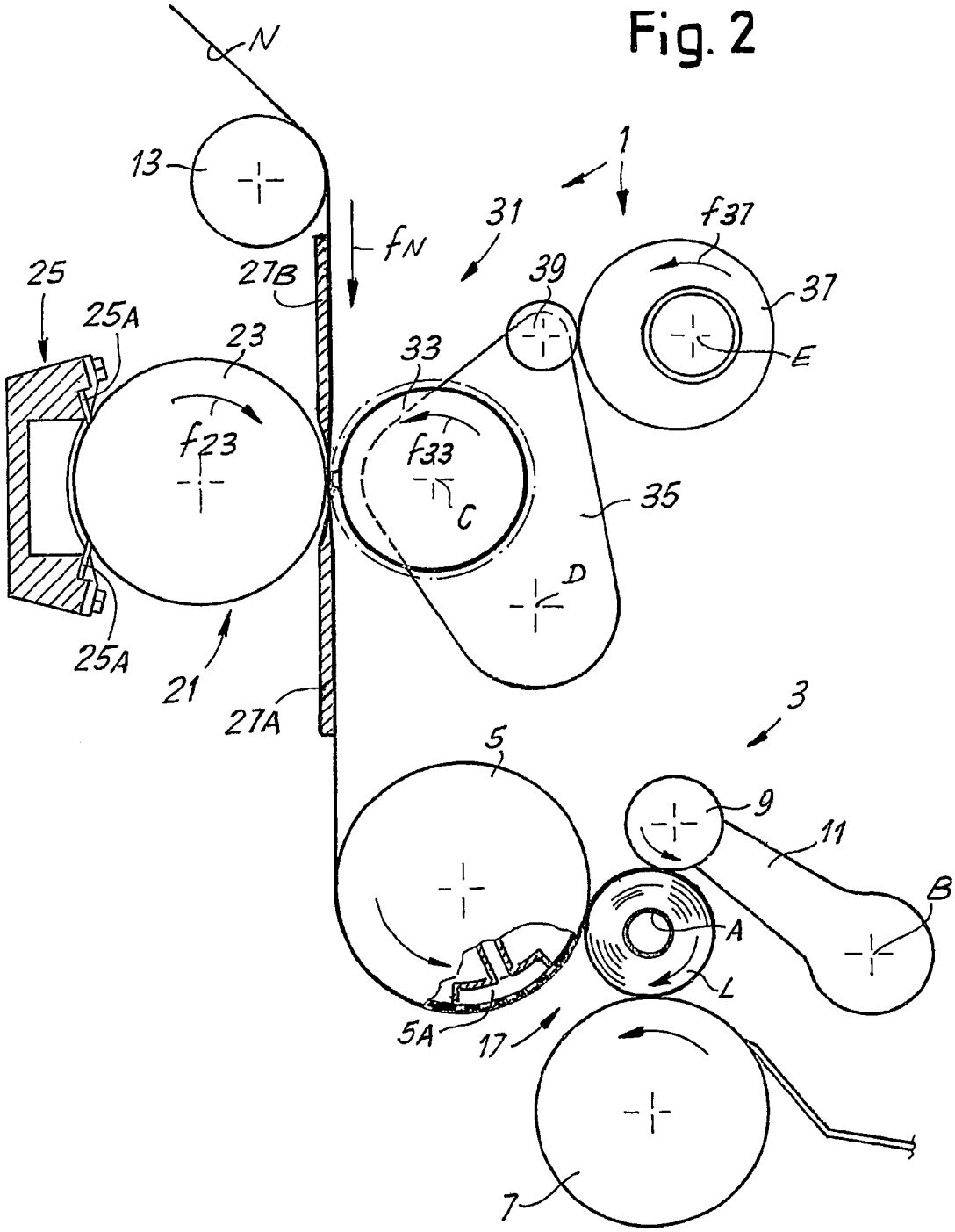
Figure 2A:
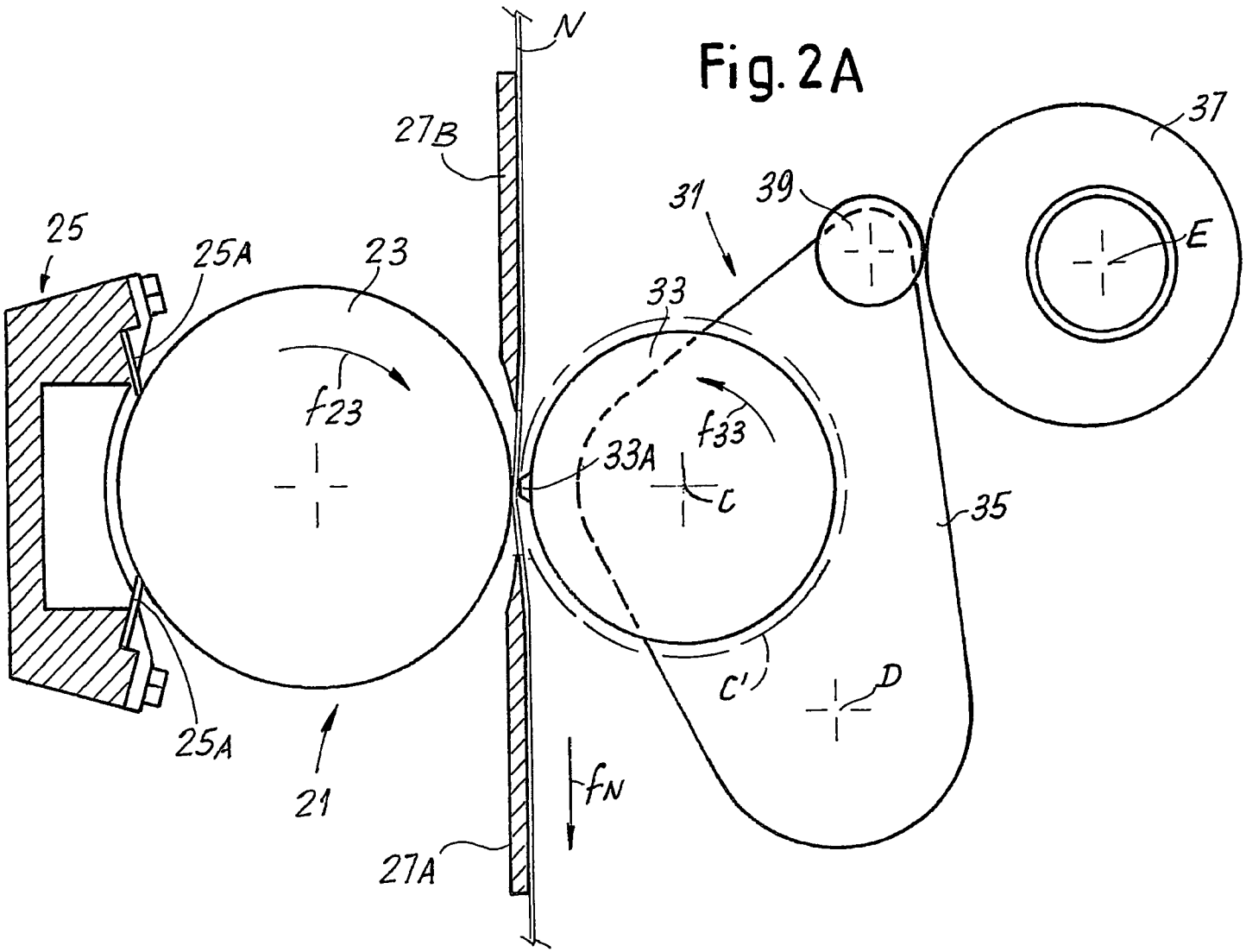

As can be seen in FIG. 1A the front surface of the radial projection 33A moves along a circular trajectory C1 with a greater radius with respect to the radius of the diverter roller 33. In this manner, by moving the diverter roller 33 towards the glue dispensing roller 23, without however causing reciprocal contact between these two rollers, the circumference C1 on which the radial projection 33A moves can be in a position so that it is tangent to, or interferes slightly with, the cylindrical surface of the glue dispensing roller 23, as shown in detail in FIG. 2A. More specifically, FIG. 2A shows a position in which the diverter roller 33, which is preferably provided with a continuous rotational motion, is in an angular position so that the radial projection 33A is exactly on the plane containing the axes of rotation of the glue dispensing roller 23 and of the diverter roller 33 respectively. The radial projection 33A is arranged inside the opening that is formed by moving the walls 27A, 27B away from each other, so that the web material N advancing according to the arrow fN along the feed path thereof can be diverted, under the action of the projection 33A, from its normal path against the glue dispensing roller 23. The layer of glue on the cylindrical surface of the glue dispensing roller 23 causes a sort of "floating" of the web material N preventing it from rubbing on the mechanical surface of the glue dispensing roller 23 which can rotate at a lower peripheral speed with respect to the feed speed of the web material N without causing breakage or damage thereto.

Preferably, the rotation speed of the diverter roller 33 is such that the peripheral speed of the front surface lying on the circumference or more precisely on the cylindrical surface C1 of the radial projection 33A is equal to or approximately equal to the feed speed of the web material N according to arrow fN. In this way damage or even accidental tearing, due to the pressurized contact of the radial projection 33A on the web material N, is avoided.

From the description above and from what can be seen in the sequence in FIGS. 1, 2, 3 and 4, operation of the device described above is apparent. In FIG. 1 the log L in the winding cradle 5, 7, 9 is not yet completed. The web material N advances freely along the feed path thereof without contact with the glue dispensing roller 23, protected by the walls 27A, 27B. Preferably, the diverter roller 33 rotates at a constant speed so that the projection 33A has a peripheral speed substantially equal to the feed speed of the web material N along the path thereof.

When the web material N must be glued, for example in an area that is to form the final free edge of the log L, the oscillating arms 35 are made to oscillate by the eccentric 37. Advantageously the eccentric 37 performs a complete rotation for each winding cycle, to take the diverter roller 33 towards the glue dispensing roller 23. This movement is synchronized such that when the roller 33 is in the position closest to the glue dispensing roller 23, the radial projection 33A will pass through the position shown in FIG. 2. In this position the web material N is diverted against the glue dispensing roller 23 to apply the desired glue to the web material. This application will take place according to gluing areas defined by the shape of the radial projection 33A. As stated above, this can be continuous or discontinuous and therefore also the glue applied to the web material N can be distributed according to a continuous line or in areas, for example according to rectilinear sections aligned axially or also according to arcs of circumference in relation to the specific gluing needs, which can depend on the quantity of glue, the type of paper or other wound web material, on the production speed, or on aesthetic requirements related to the final characteristics of the product.

The glue application system according to the invention allows, for example, the radial projection to be designed in a specific shape, to apply glue according to a pattern. For example, the radial projection 33A can have a front surface reproducing a logo or written message. Preferably utilizing a colored glue, a sort of "stamp" is obtained on the final edge of the log, visible from the outside.

Figure 3:
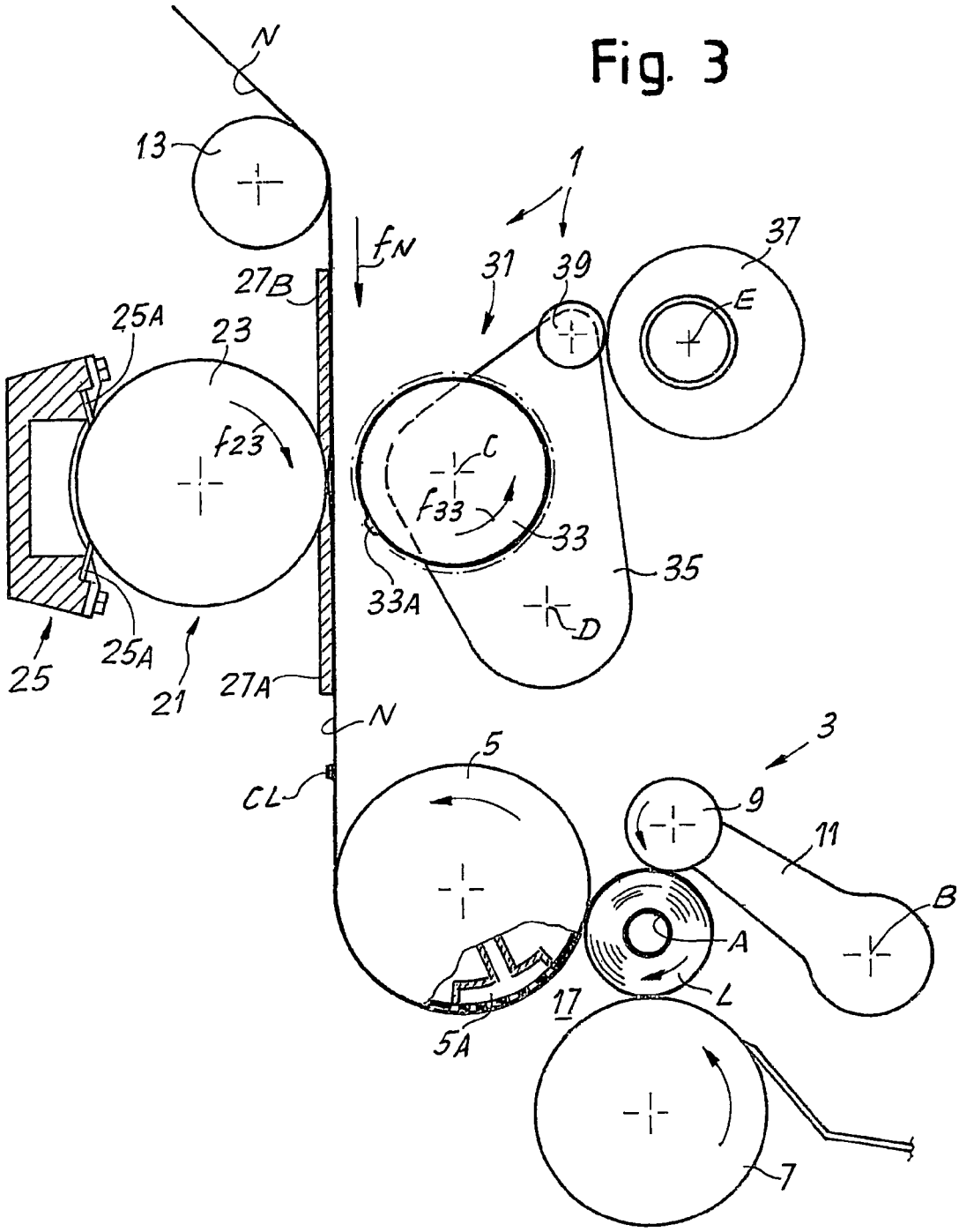
Figure 4:
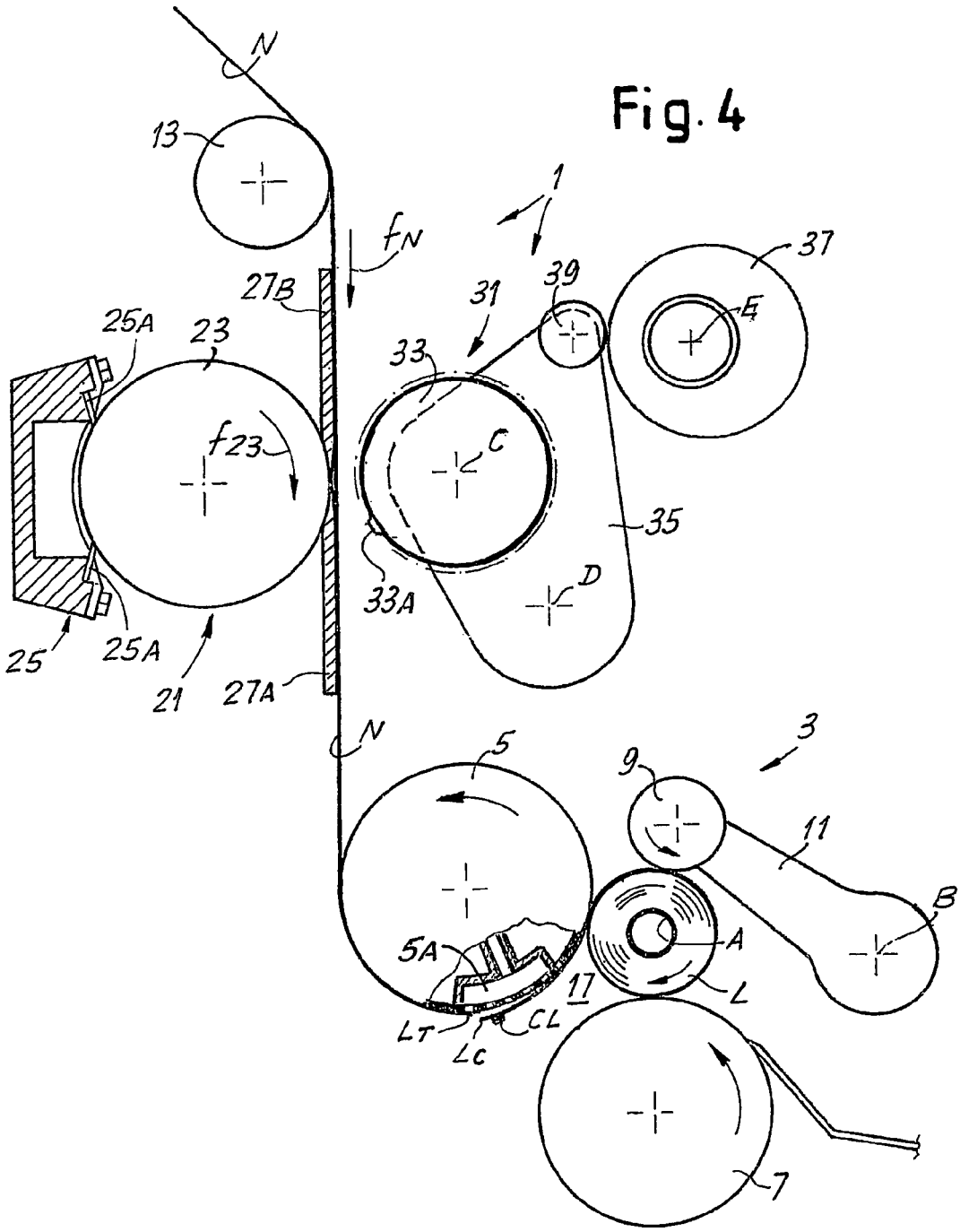

In FIG. 3 the glue CL has been applied to the web material N and advances therewith towards the winding area. In FIG. 4 the web material N has been severed to create a final free edge LC and an initial free edge LT. In this embodiment the glue CL is in proximity of the final edge LC and will be used to seal, i.e. to close, the log L. As mentioned above, it would also be possible for the glue CL to instead be applied in proximity of the initial edge LT or both in proximity of the edge LC and in proximity of the edge LT to perform on the one hand closing of the final free edge of the log L and on the other adhesion of the initial edge LT to a new winding core A which, in a manner known per se, will be inserted in the rewinding machine. The glue on the two areas can, for example, be applied by providing radial projections 33A of suitable shape and position. For example, radial projections 33A with an adequate circumferential extension could be utilized, so as to form strips of glue on both sides of the tearing or severing line of the web material. Alternatively, two radial projections 33A arranged in subsequent angular positions can be utilized. According to requirements, the oscillating movement of the arms 35 can also be controlled so as to maintain the axis C of rotation of the diverter roller 33 in the position closest to the axis of rotation of the glue dispensing roller 23 for sufficient time. This can be obtained by decelerating rotation of the eccentric 37, or by utilizing an eccentric, or a cam 37, of suitable shape.

Figure 5:
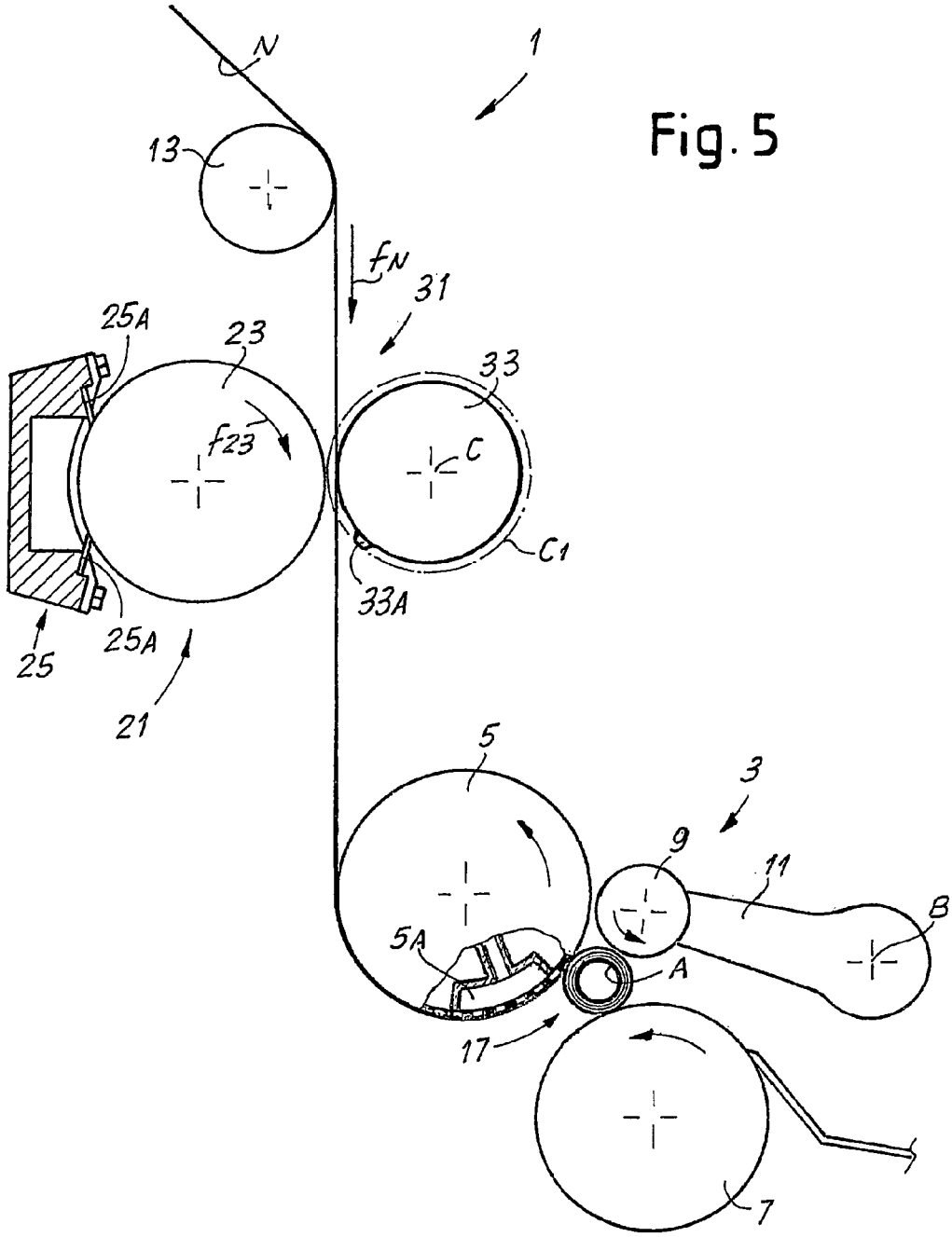
FIGS. 5, 6, and 7 show a second embodiment of the invention in different steps of the winding cycle.
Figure 6:
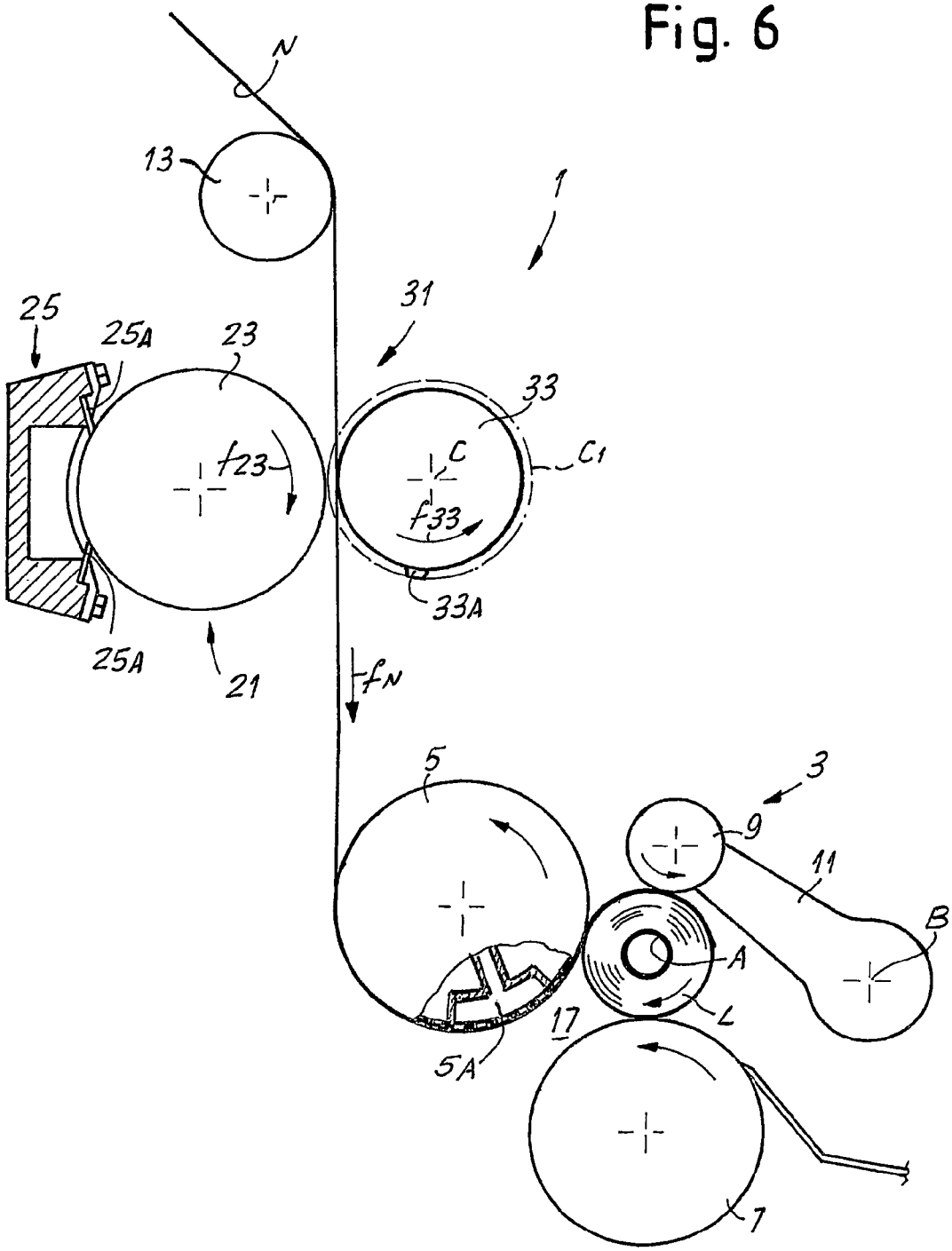
Figure 7:
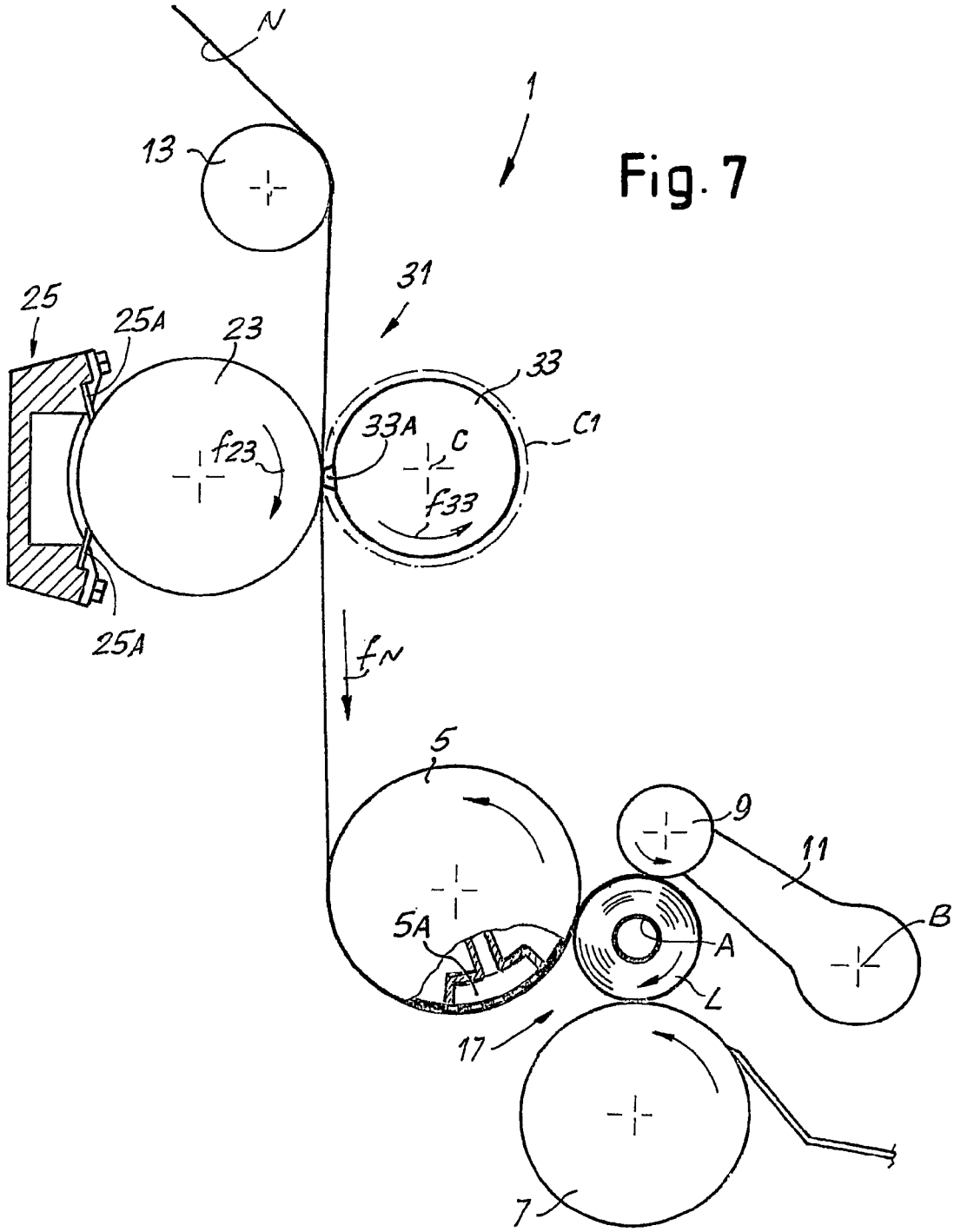
Figure 8:
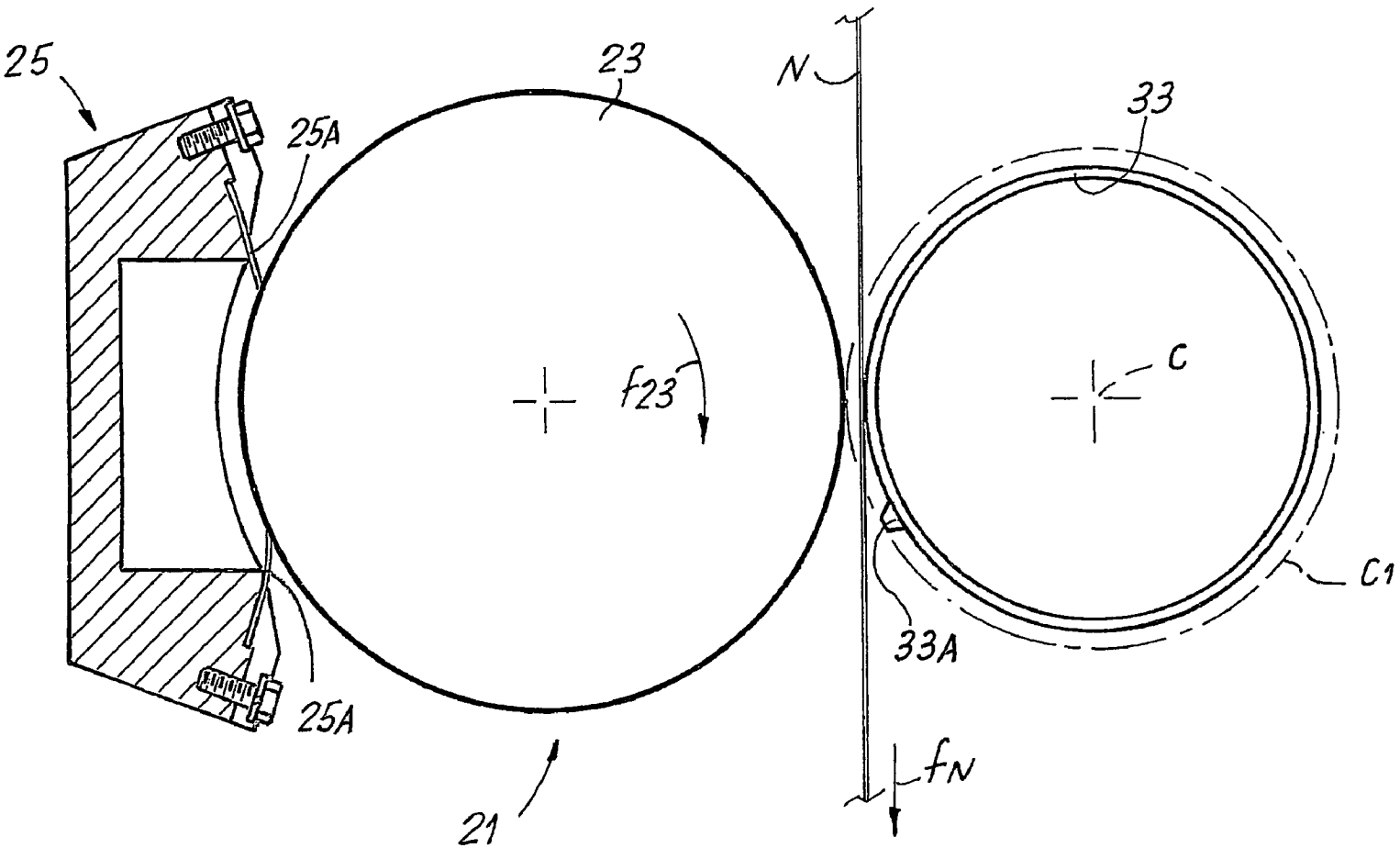
FIG. 8 shows a detail of the glue dispenser and of the diverter member in the embodiment in FIGS. 5 to 7.

In a different embodiment, shown in the operating sequence in FIGS. 5, 6 and 7 and in the detail in FIG. 8, in which the same numbers indicate the same or equivalent parts with respect to those in FIGS. 1 to 4, the diverter roller 33 can rotate about a fixed axis C. In this case, the diverter roller 33 will be provided with a discontinuous rotational movement and rotation will only be activated during the exchange step or during the period required to apply glue in proximity of the initial free edge LT or of the final free edge LC or of both as described above.

In this case, the diverter roller 33 can advantageously be made of a lightweight material, such as carbon fiber reinforced resin and have a thickness suitably limited to reduce inertia of the roller and facilitate rapid angular acceleration immediately before the glue application step. As can be understood from the sequence in FIGS. 5, 6, and 7, operation of the rewinding machine in this case is as follows: during the step to wind the log L the web material N is fed according to the arrow fN along the feed path thereof without interfering with the diverter member 33. This member (FIG. 5) is in a fixed angular position, in which the radial projection 33A does not touch the web material N. The idle angular position is such that the radial projection 33A is in the farthest angular position possible with respect to the direction of rotation taken by the diverter roller 33 in the subsequent step, with respect to the active position in which this projection 33A will interfere with the feed path of the web material N. This allows a greater angle to be obtained to perform angular acceleration of the roller 33.

When glue must be applied to the web material N, the diverter roller 33 will be accelerated and will start to rotate according to the direction of the arrow f23 (FIG. 6) gradually taking the projection 33A towards the area of action on the web material N. FIG. 7 shows the instant in which the radial projection 33A pushes, i.e. diverts, the web material N from the normal feed path thereof, against the glue dispensing roller 23 to transfer glue to the web material N in the desired point.

FIG. 8 shows an enlarged detail of the glue dispenser 21 with the glue dispensing roller 23 positioned on one side of the feed path of the web material N and, on the opposite side of this path, the diverter roller 33 with the radial projection 33A thereof in the idle position.

Figure 10:
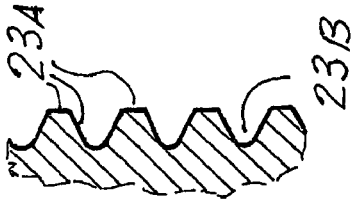
FIG. 10 shows a local section according to X-X in FIG. 9.
Figure 9:
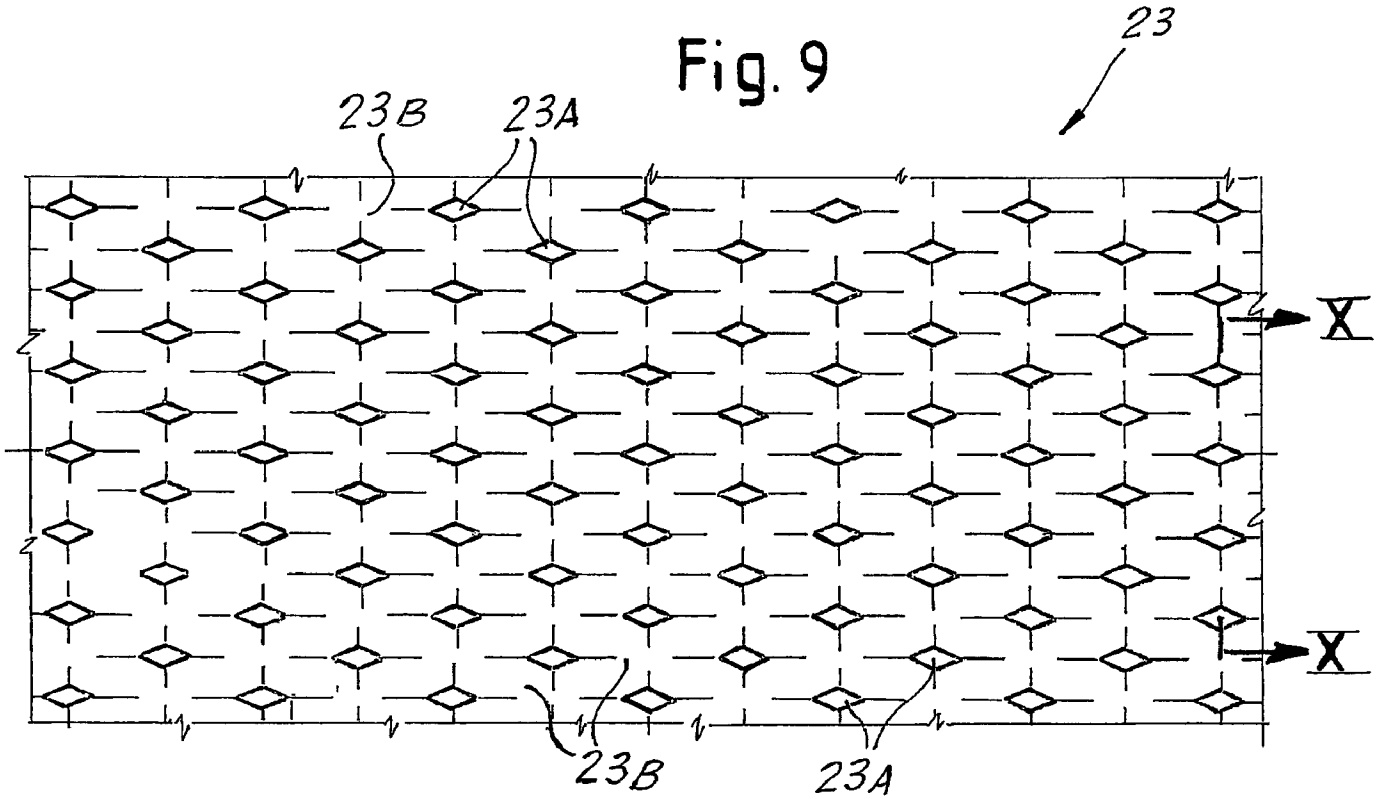
FIG. 9 shows a greatly enlarged portion of the cylindrical surface of the glue dispensing roller.

In an advantageous embodiment, which can be applied both to the embodiment of FIGS. 1 to 4 and to the embodiment of FIGS. 5 to 8, the cylindrical surface of the glue dispensing roller 23, advantageously and preferably made of steel, has an engraved surface pattern as shown in FIGS. 9 and 10. This pattern is defined by helical incisions, which can be obtained by two passes of a hob, and which intersect to form frusto-pyramidal shaped projections or protuberances 23A on the surface of the roller. The helical grooves defining the projections 23A are indicated with 23B. This configuration allows a film of glue of adequate thickness to form on the cylindrical surface of the glue dispensing roller 23.

The structure shown in FIGS. 9 and 10 can be utilized in all the various embodiments of the rewinding machine described herein.

Advantageously, a suction sector 5A can be provided inside the winding roller 5, positioned approximately level with the nip 17 between the winding rollers 5 and 7. This suction sector 5A can be utilized to generate localized suction in the area in which the sector is disposed, through holes provided in the cylindrical wall of the winding roller 5. Preferably, the entire cylindrical side wall of the winding roller 5 is perforated. With this arrangement both the final edge LC and optionally the initial edge LT of the web material N can be held adhering to the cylindrical surface of the roller 5 after severing thereof.

Insertion of the optional winding cores and severing of the web material can be obtained with one of the various known methods, as how these operations are performed is not relevant for the purposes of the invention. The subsequent FIGS. 11 to 14 show a further embodiment of the invention, which also shows a possible embodiment of the core feeder means and a possible embodiment of the web material severing means. It must be understood that these mechanisms to feed the cores and to sever the web material can also be utilized in the embodiments described with reference to FIGS. 1 to 8

Figure 11:
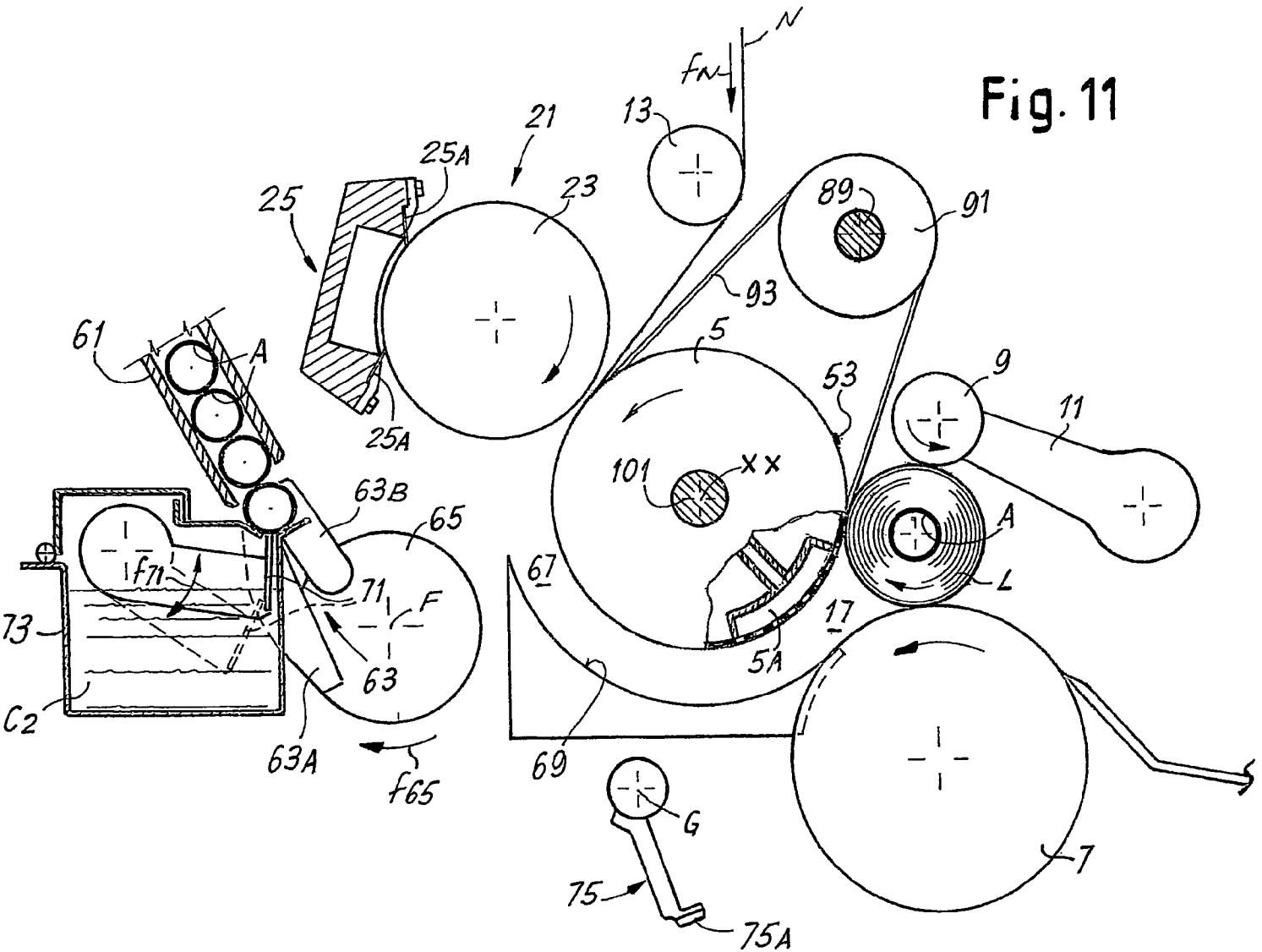
FIGS. 11 to 14 show subsequent operating steps of a rewinding machine in a further embodiment.

With initial reference to FIG. 11, in this possible embodiment the path of the web material N according to the arrow fN again extends around a guide roller, once more indicated with 13, towards a winding unit formed by winding rollers 5, 7 and 9 arranged and designed as described above.

Once again, the glue dispenser 21, with the glue reservoir 25 and the relative doctor blades 25A to distribute glue on the engraved cylindrical surface, for example as shown in FIGS. 9 and 10, of a glue dispensing roller 23 is arranged on one side of the feed path of the web material. Unlike the previous embodiments, in this embodiment the glue dispensing roller 23 advantageously cooperates with a diverter member constituted by radial projections 53 movable according to the arrow f53 along a circular trajectory coaxial with the winding roller 5. The projections 53 defining the diverter member move with a movement substantially equivalent to the one described with reference to FIGS. 5 to 7, i.e. performing a rotation for each winding cycle of a log L, synchronized with the movement of the remaining members of the machine so that the diverter member 53 interferes with the feed path of the web material N to divert it against the glue dispensing roller 23 in the instant in which glue must be applied to the web material N, i.e. in an instant immediately prior to severing of the web material, formation of the initial and final edges LT, LC, and, if necessary, insertion of a new winding core.

The mechanical configuration that allows the diverter member 53 to be supported and moved will be described in greater detail below with reference to FIGS. 15 and 16.

FIG. 11 also shows a channel 61 for feeding winding cores A. These cores are picked up individually by a pick-up member 63 supported by a rotor 65 which rotates about an axis of rotation F. The pick-up member is formed of two elements 63A, 63B movable with respect to each other to grip individual winding cores A and transfer them, with a rotational movement according to the arrow f65, towards the inlet of a channel 67 defined between the cylindrical surface of the upper winding roller 5 and a rolling surface 69 substantially coaxially to the cylindrical surface of the winding roller 5. The height of the channel is preferably slightly less than the diameter of the cores A, which can be elastically yielding to be inserted in said channel.

A glue is applied to the winding cores A by means of a gluing element 71 oscillating according to the double arrow f71 to be immersed in a reservoir 73 containing a glue C2 used to anchor the initial free end LT to the respective winding core A when the latter is inserted in the channel 67.

Arranged underneath the surface 69 inferiorly delimiting the channel 67 is an axis of rotation G of a rotating severing device 75 provided with pressers 75A which, in a manner known per se, cooperate with the cylindrical surface of the winding roller 5 to sever the web material. Operation of the system to sever the web material described briefly here is illustrated schematically in the sequence in FIGS. 11 to 14 and known per se. For greater details regarding the operation of this severing system reference should be made to WO-A-9421545.

According to an advantageous embodiment, a suction sector 5A is again arranged inside the winding roller 5, positioned approximately in the area of the nip 17 between the winding rollers 5 and 7 for the purposes described above.

With reference to the sequence in FIGS. 11 to 14, operation of the rewinding machine in this embodiment is as follows. In FIG. 11 the log L in the winding cradle 5, 7, 9 is still being formed. The diverter member 53 constituted by the radial projections coaxial with the winding roller 5 are in an idle position. The web material N advances without being disturbed by the projections 53 and therefore without touching the glue dispensing roller 23. The glue dispensing roller 23 rotates continuously at a speed equal, for example, to one tenth and in general preferably between 5 and 50% of the feed speed of the web material N.

Figure 12:
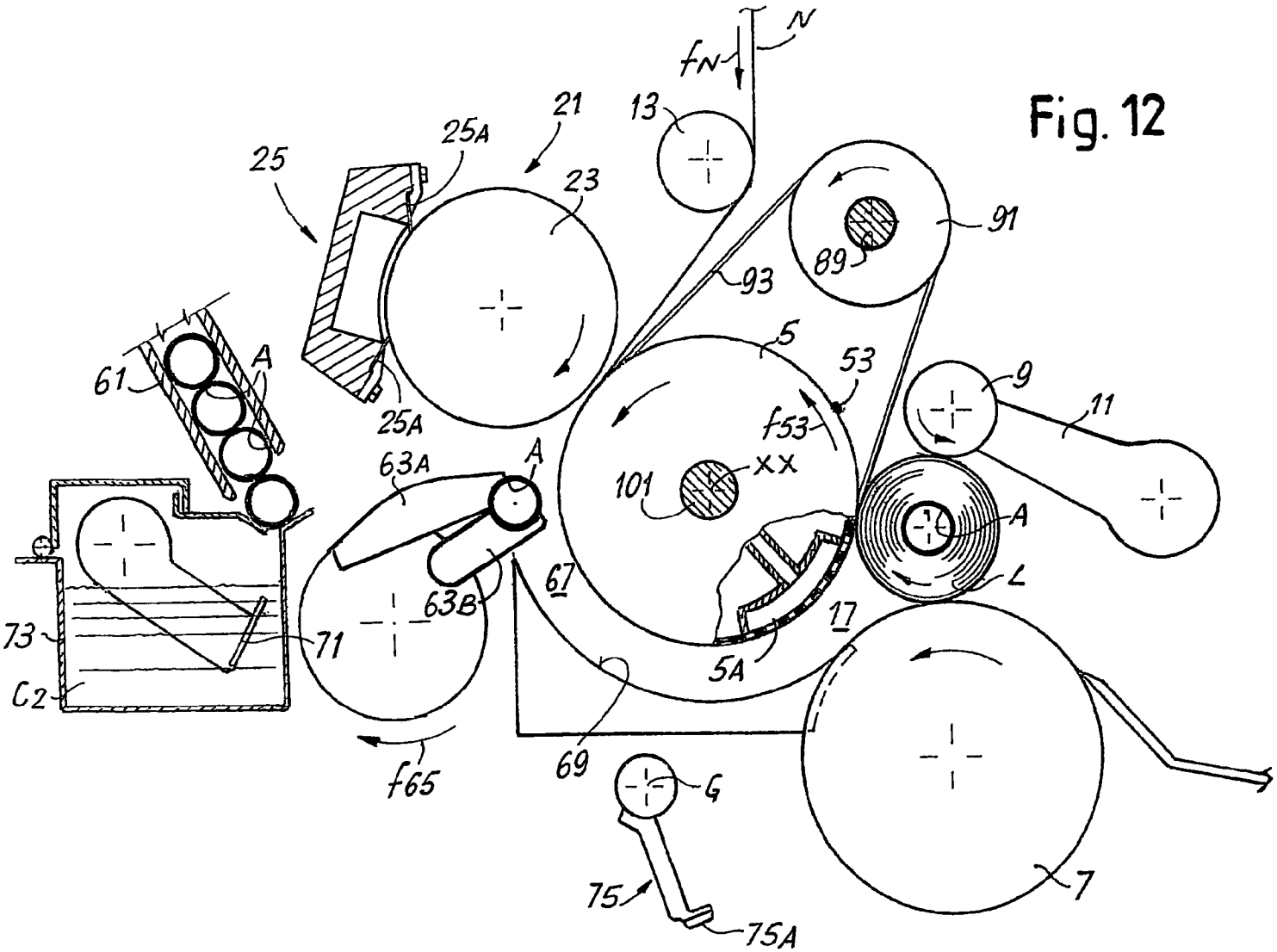

In FIG. 12 the winding of log L is almost complete and the diverter member 53 starts to rotate according to the arrow f53 towards the area in which the web material N comes into contact with the winding roller 5.

Figure 13:
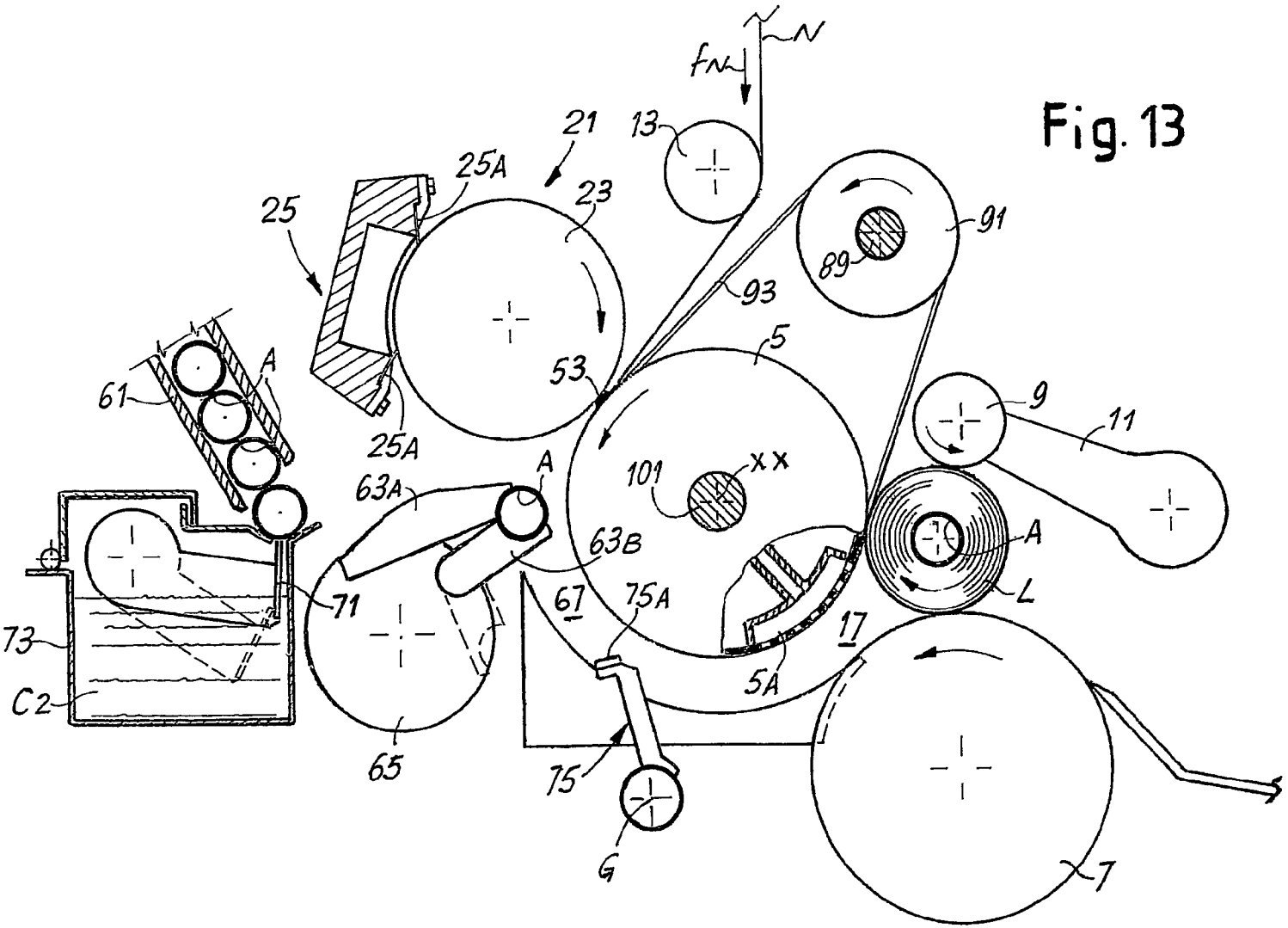

In FIG. 13 the diverter member 53 is in the nip between the winding roller 5 and the glue dispensing roller 23, in a position to divert the path of the web material N against the glue dispensing roller 23 and thus take the web material N into contact with the film or layer of glue on the roller 23. In the meantime, a new core A has been moved towards the channel 67 and the severing device 75 has started to rotate entering an operating area, i.e. inside of the channel 67.

Figure 14:
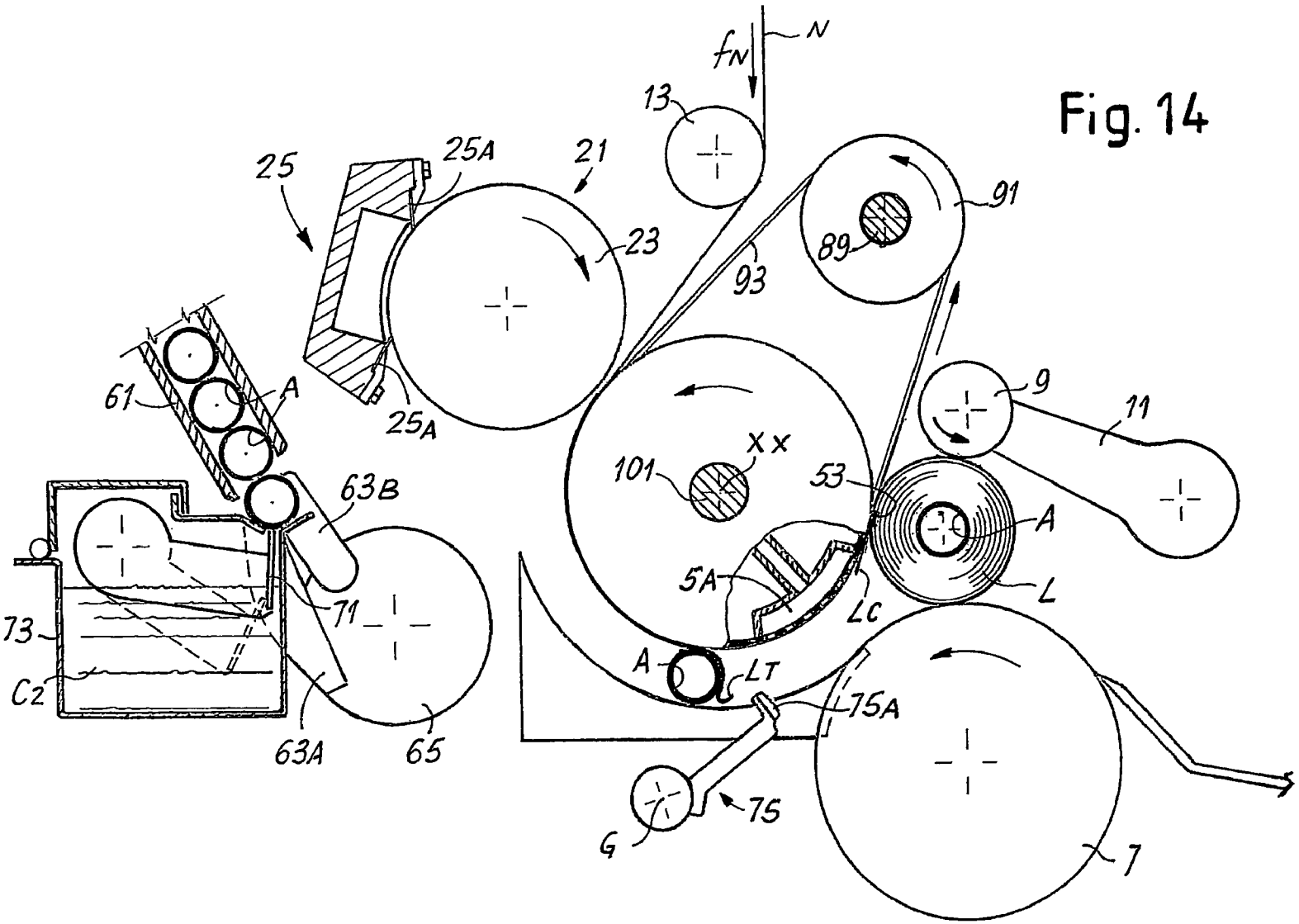

In FIG. 14 the diverter member 53 has moved out of the operating area and is oriented towards the log L being completed. The web material N has been severed generating the final free edge LC and the initial free edge LT. The latter is made to adhere to the new core A inserted in the core insertion channel 67. The severing device 75 is withdrawing, passing under the core rolling surface 69 which, for this purpose, is comb shaped, while the severing device 75 is formed of individual elements which are inserted in the empty spaces between plates defining the comb forming the surface 69, all as known to those skilled in the art. Advantageously, in this embodiment the log L can still be in contact with the cylindrical surface of the winding roller 5 in this step, so that the projection forming the diverter member 53 can press the final free or tail edge LC against the outer surface of the log L to facilitate gluing. With an adequate variation in the peripheral speed of the winding rollers 7 and 9, the log L is then unloaded and a new core A, around which the initial free edge LT of the web material starts to wind, passes through the nip 17 between the rollers 5 and 7.

Figure 15:
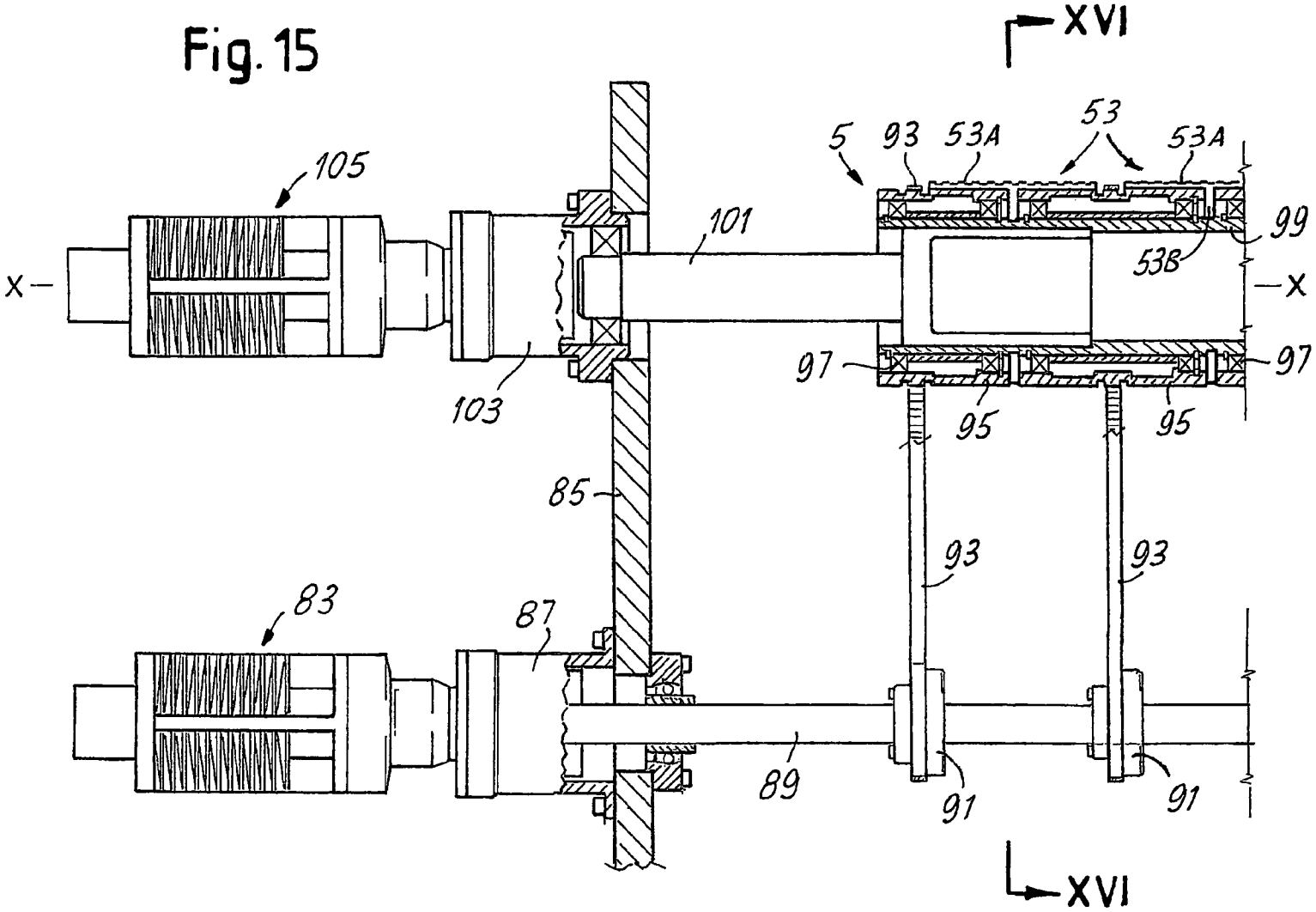
FIGS. 15 and 16 shows the structure of the upper winding roller and of the diverter member in the embodiment in FIGS. 11 to 14.
Figure 16:
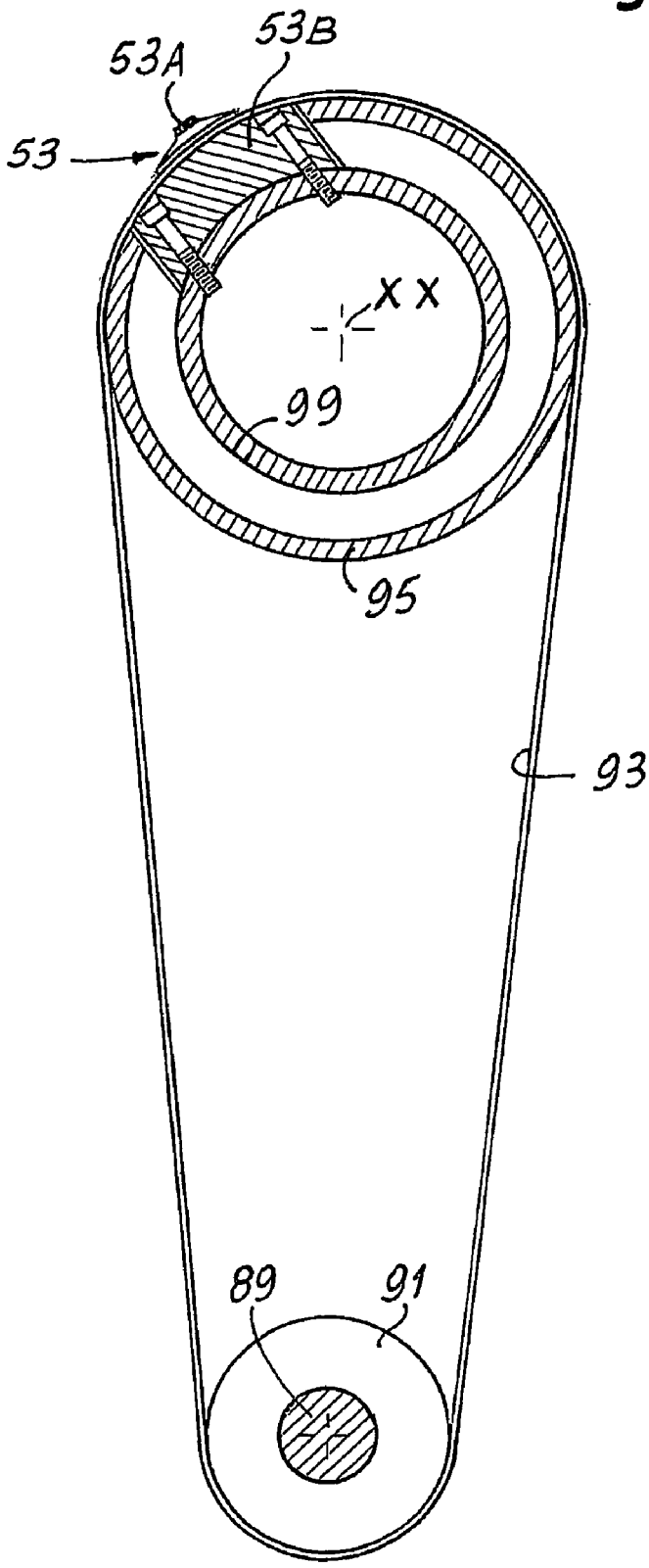
Figure 17:
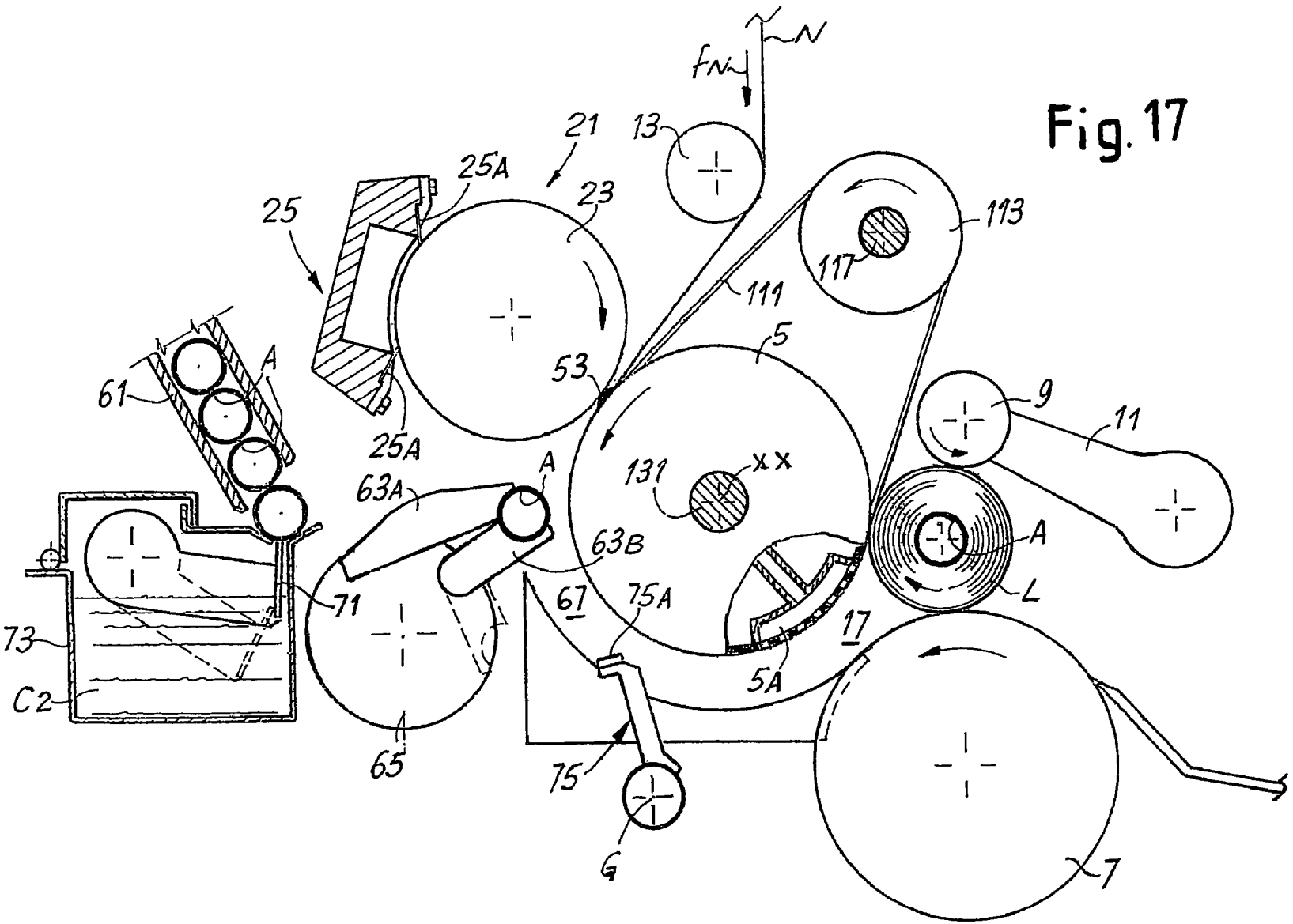
FIGS. 17, 18, 19 and 20 show the diverter member and operation thereof in a different embodiment.
Figure 18:
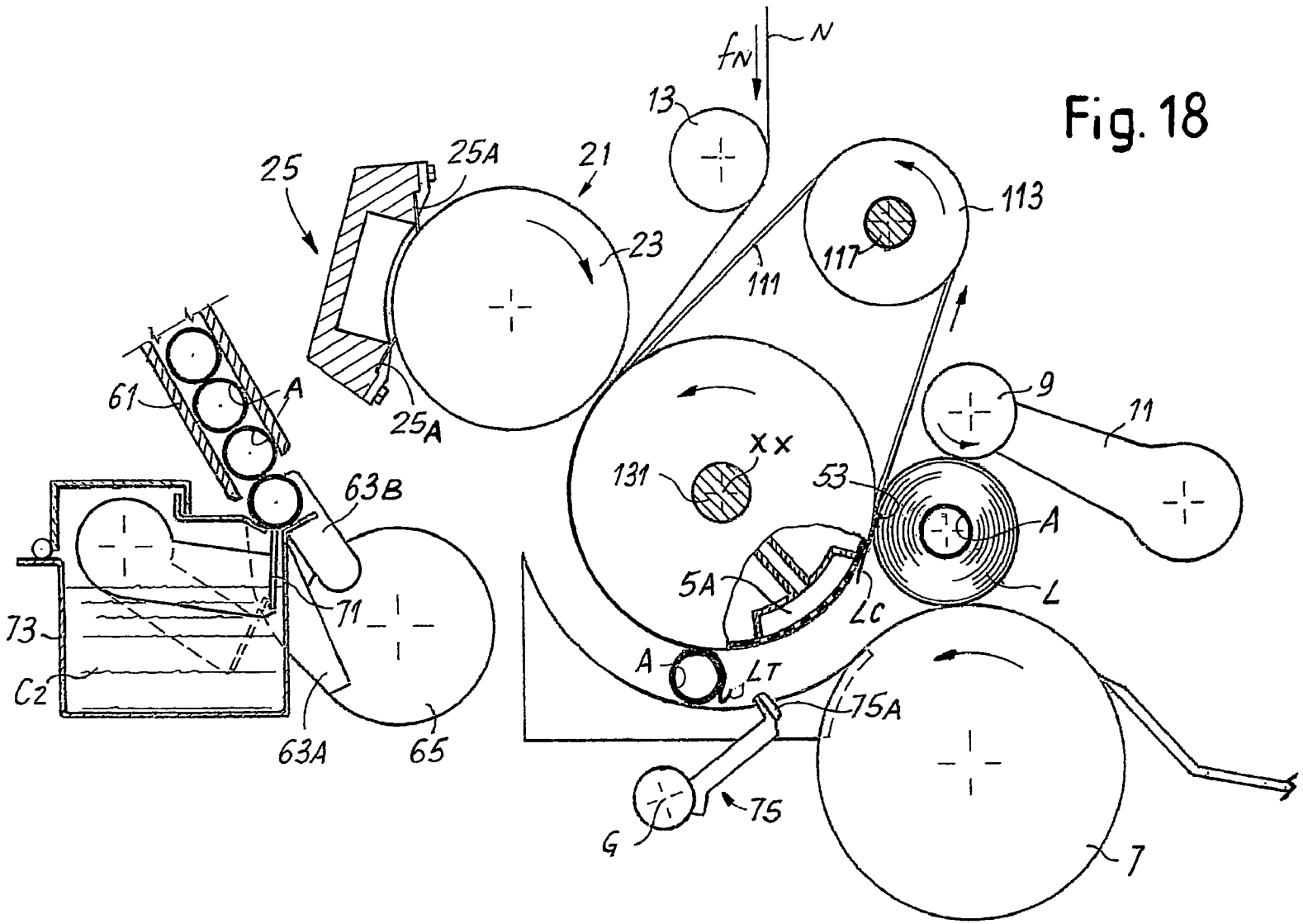
Figure 19:
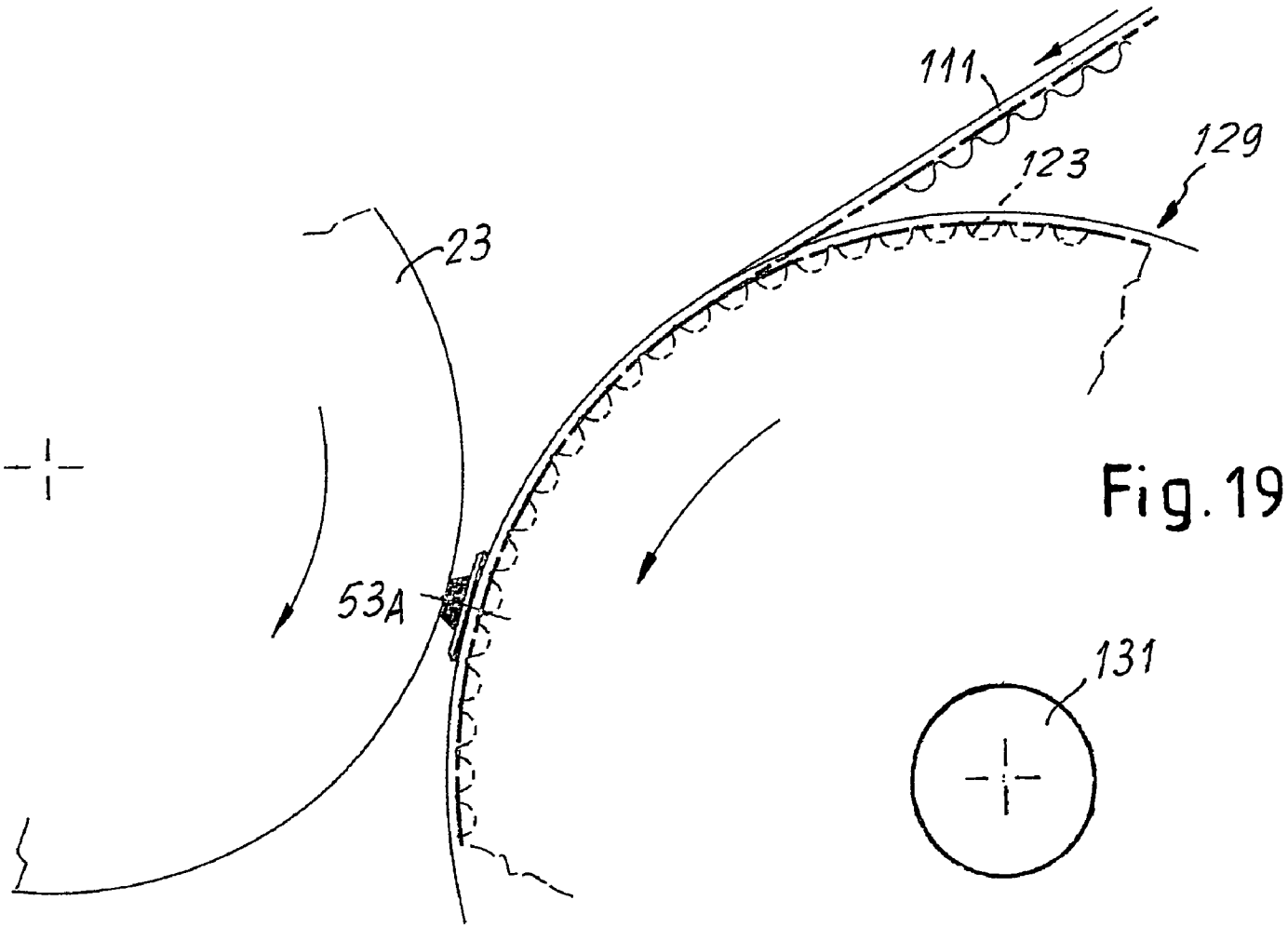
Figure 20:
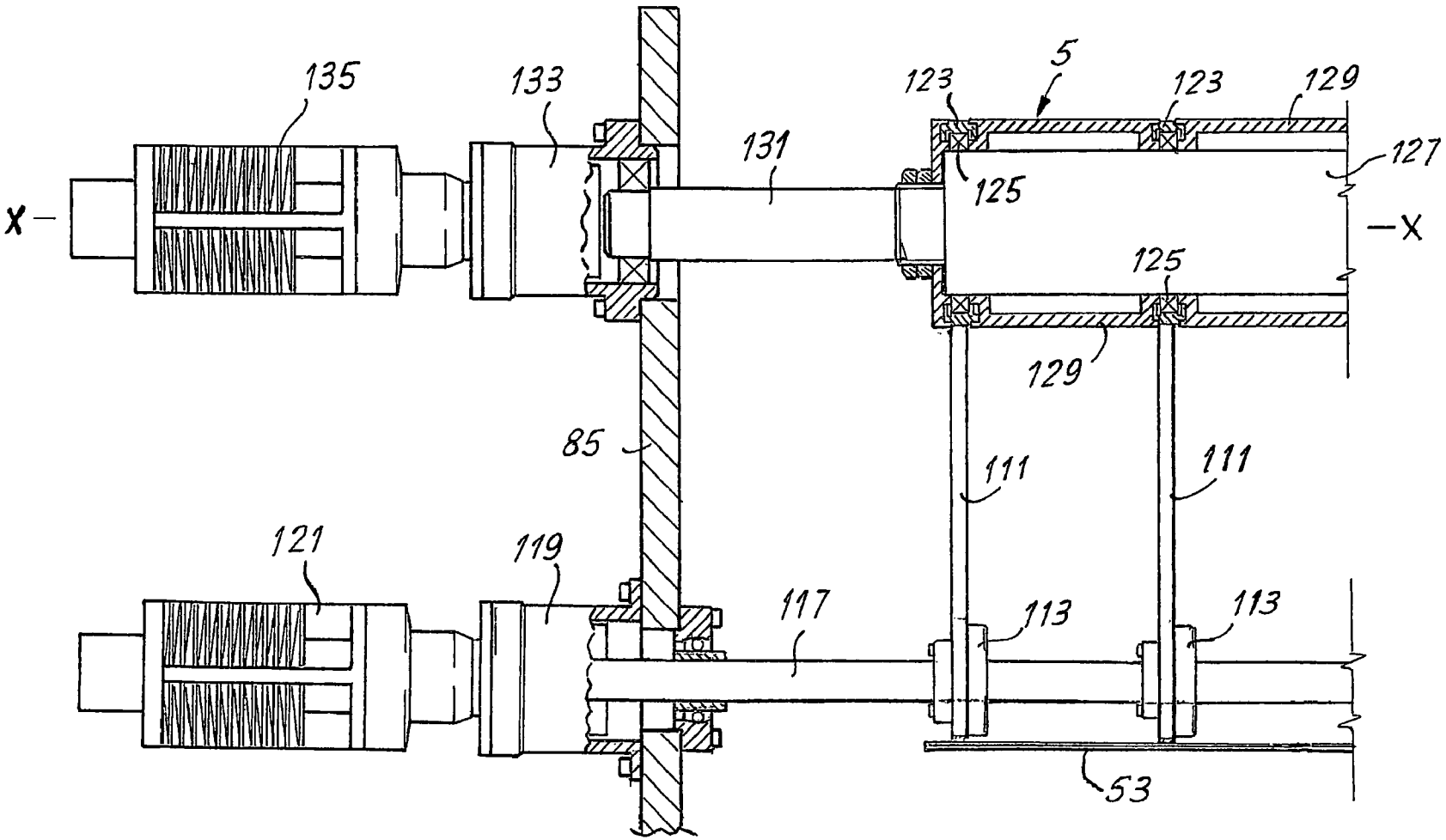

FIGS. 15 and 16 show a possible embodiment of the upper winding roller 5 and of the diverter member 53, as well as of the corresponding means to cause rotation thereof. More specifically, FIG. 15 shows a section along a plane containing the axis of rotation of the winding roller 5 and the axis of the drive shafts that provide the motion for the winding roller and the diverter roller 53.

In this embodiment a first motor 83 is provided mounted, for example, on a side panel 85 of the machine, which transmits, through a coupling 87, the motion to a shaft 89. Pulleys 91 for belts 93 are mounted on the shaft 89. These provide the motion for cylindrical members 95 coaxial with the axis X-X of the winding roller 5. In practice, the cylindrical members 95 aligned with each other form, with the outer cylindrical surfaces thereof, the winding roller 5, and therefore it is the motor 83 that transmits rotational motion to the winding roller 5. The individual cylindrical members 95 are supported by bearings 97 on an inner sleeve 99 coaxial with the axis X-X and torsionally constrained to a shaft 101 which takes its motion, through a coupling 103, from a motor 105. This is the motor that transmits motion to the diverter member 53.

The diverter member 53 is defined by a plurality of ribs 53A preferably aligned along a line parallel to the axis X-X. Each rib 53 is integral with the sleeve 99 by means of a mechanical support 53B which passes through an annular free space provided, for each rib 53A, between two contiguous cylindrical members 95.

In this manner, through the motor 105, a rotational movement about the axis X-X can be transmitted to the sleeve 99, and consequently to the ribs 53A forming the diverter member 53, which is entirely independent with respect to the rotational motion of the winding roller 5, transmitted by the motor 83. The two motors 83, 105 are controlled so as to maintain the winding roller 5 at the desired rotation speed and to impart to the diverter member 53 the movement desired of one rotation at each winding cycle of a log L, all as described with reference to the sequence in FIGS. 11 to 14.

FIG. 16 shows in a cross section according to XVI-XVI the arrangement described below of the winding roller 5, of the diverter member 53 and of the belts 93 with the respective pulleys 91 on the shaft 89.

In the embodiment in FIGS. 11 to 16 therefore, the diverter member 53 is inserted between the winding roller 5 and the path of the web material N diverting this material against the glue dispensing roller 23. The trajectory of the diverter member 53 is a circular trajectory coaxial with the winding roller 5.

FIGS. 17 to 20 shows a modified embodiment. The operating cycle of this embodiment will not be described as it is substantially the same as the one in FIGS. 11 to 15. This embodiment, nonetheless, differs from the previous one by the different way of moving the diverter member 53. In fact, in this embodiment, the diverter member 53 is formed by a rib supported by a plurality of belts 111 which, as in FIGS. 11 to 15 for the belts 93, can advantageously be toothed belts to ensure phasing is maintained with respect to the pulleys that transmit motion to said belts.

The belts 111 are driven around pulleys 113 mounted (FIG. 20) on a drive shaft 117 controlled, through a coupling 119, by a motor 121 supported by the side panel 85 of the machine. The belts 111 are also driven around pulleys 123 coaxial with the winding roller 5, i.e. arranged on an axis X-X. The pulleys 123 are supported by bearings 125 on a sleeve 127 coaxial with the winding roller 5. Mounted on the sleeve 127 are cylindrical members 129, substantially equivalent to the cylindrical members 95 but which, being coupled torsionally with the sleeve 127, rotate therewith. The sleeve 127 and consequently the cylindrical members 129, which define the cylindrical surface of the winding roller 5, receive motion from a drive shaft 131. Rotation of this shaft is controlled, through a coupling 103; by a motor 135 also supported by the side panel 85.

With the motors 135 and 121 it is again possible, in the same manner described with reference to the motors 83 and 105 in FIG. 15, to make the winding roller 5 and the diverter member 53 rotate at different speeds from each other. The motor 135 maintains the winding roller 5 in rotation at the desired speed, substantially equal to the feed speed of the web material N, while the motor 121 makes the belts 111 move along the closed path thereof by moving, with the desired law of motion, the diverter member 53 along this closed trajectory. Movement of the diverter member 53 is controlled to carry out the same operation performed by the diverter member 53 in the previous embodiment.

It is understood that the drawing only shows an example provided by way of a practical arrangement of the invention, which can vary in forms; and arrangements without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A method for producing logs of web material, comprising:

feeding a web material along a feed path;

arranging a glue dispensing member on a first side of said feed path;

winding an amount of the web material in a log;

arranging a diverter roller on a second side of said feed path, said feed path extending between said glue dispensing member and said diverter roller;

temporarily diverting the feed path of the web material towards said glue dispensing member to apply glue to the web material;

after having applied said glue, and upon completion of winding a log, severing the web material forming a final free edge of a wound log and an initial free edge to start winding of a subsequent log, wherein said severing of the web material is controlled such that said glue is applied on the final free edge of said wound log forming a glued tail end;

winding said glued tail end on said wound log to seal said wound log; and further including controlling said diverter roller to perform a rotation at an end of a winding cycle of each log and to remain inoperative during winding of said each log.

2. The method as claimed in claim 1, wherein said winding is performed by a peripheral winding system and wherein said glue applied on the web material is moved towards a winding cradle before severing the web material, the winding cradle being downstream of the diverter roller.

3. A rewinding machine for producing logs of web material, comprising: a winding unit; a feed path of the web material towards said winding unit; a severing device to sever the web material upon completion of winding each log to generate a tail end of said log and a leading end to start winding of a subsequent log; a glue dispenser to apply glue to the web material; a rotatable diverter roller with a radial projection, arranged in front of said glue dispenser, the feed path of the web material passing between said glue dispenser and said diverter roller and said diverter roller being arranged to temporarily divert the web material towards said glue dispenser, wherein said diverter roller is further arranged to perform a rotation at an end of a winding cycle of said each log and to remain inoperative during winding of said each log; wherein said diverter roller and said severing device are arranged and adapted to apply said glue on a portion of said web material before severing said web material such that said glue is applied on said tail end of said log so that said glue serves to adhere said tail end on said log.

4. The rewinding machine as claimed in claim 3, wherein said radial projection, said diverter roller and said glue dispenser are constructed and arranged so that said radial projection presses against the glue dispenser when said radial projection is positioned in a nip between the diverter roller and the glue dispenser.

5. The rewinding machine as claimed in claim 3, wherein said diverter roller is provided with an oscillating movement to move towards and away from said glue dispenser.

6. The rewinding machine as claimed in claim 3, wherein during at least part of the rotation of the diverter roller, the radial projection of the diverter roller has a peripheral speed substantially equal to a feed speed of the web material.

7. The rewinding machine as claimed in claim 3, wherein said glue dispenser comprises a roller with a substantially cylindrical side surface engraved with a series of intersecting helical grooves, defining substantially frusto-pyramidal shaped protuberances.

8. The rewinding machine as claimed in claim 3, wherein said glue dispenser comprises a protective element.

9. The rewinding machine as claimed in claim 8, wherein said protective element comprises two movable walls, which in a first position separate the glue dispenser from the feed path of the web material and in a second position define an opening through which the web material is diverted to be brought into contact with the glue dispenser.

10. The rewinding machine as claimed in claim 3, wherein the winding unit is a peripheral winding unit arranged downstream of the diverter roller with respect to the feed path of the web material.

11. The rewinding machine as claimed in claim 3, wherein the severing device is arranged and adapted such that the web material having glue thereon is delivered towards a winding cradle downstream of the diverter roller.

* * * * *